US005280745A

United States Patent [19]

Maruno

[11] Patent Number: 5,280,745

[45] Date of Patent: Jan. 25, 1994

[54] RADIAL-PLUGER-TYPE APPARATUS WITH VARIABLE PLUNGER STROKE

[75] Inventor: Fujiya Maruno, Tokyo, Japan

[73] Assignee: Honda Giken Kogyo Kabushiki Kaisha, Tokyo, Japan

[21] Appl. No.: 887,257

[22] Filed: May 22, 1992

[30] Foreign Application Priority Data

May 22, 1991 [JP] Japan ..... 3-146862

[51] Int. Cl.[5] ..... F04B 1/10

[52] U.S. Cl. ..... 91/477; 417/221; 417/273

[58] Field of Search ..... 417/221, 273; 91/497; 92/12.1, 13

[56] References Cited

FOREIGN PATENT DOCUMENTS 394061 10/1990 European Pat. Off. .
37465 2/1991 Japan .

*Primary Examiner*—Richard E. Gluck
*Attorney, Agent, or Firm*—Lyon & Lyon

[57] ABSTRACT

A variable-stroke radial-plunger-type apparatus for use as an air compressor, for example, has a main shaft rotatably disposed in a casing assembly, an eccentric collar angularly movably mounted on a eccentric crankpin of the main shaft, and a coupling ring angularly movably mounted on the eccentric collar. A plurality of radial plungers with inner ends coupled to the coupling ring are slidably fitted in respective cylinders that are rockably supported it the casing assembly. The angular movement of the eccentric collar on the crankpin is adjusted by a stroke adjusting mechanism. The coupling ring can be positioned with respect to the main shaft and the casing assembly by a W-mechanism. The W-mechanism may comprise external and internal gears or pulleys and sprockets.

25 Claims, 12 Drawing Sheets

RADIAL-PLUGER-TYPE APPARATUS WITH VARIABLE PLUNGER STROKE

BACKGROUND OF THE INVENTION

1. Field of the Invention

The present invention relates to a radial-plunger-type apparatus such as a pump, a compressor, or the like which has cylinders and plungers that extend radially around a main shaft, and more particularly to such a radial-plunger-type apparatus with plungers reciprocally movable in respective cylinders over variable strokes.

2. Description of the Prior Art

One variable-stroke radial-plunger-type apparatus is disclosed in Japanese Patent Application No. 3-37465, for example, filed by the assignee of the present application. The disclosed variable-stroke radial-plunger-type apparatus will be described below with reference to FIG. 16 of the accompanying drawings.

As shown in FIG. 16, the variable-stroke radial-plunger-type apparatus comprises a main shaft (not shown) having an axis C1 and including an integral crankpin 501 having an axis C2 displaced off the axis C1. When the main shaft rotates about its own axis C1, the crankpin 501 revolves around the axis C1. An eccentric collar 502 is relatively rotatably mounted on the crankpin 501. The eccentric collar 502 has an outer circumferential surface 502 a whose center C3 of curvature is displaced off the axis C2 of the crankpin 501.

The variable-stroke radial-plunger-type apparatus has a stroke adjusting mechanism for adjusting the angle through which the eccentric collar 502 is angularly moved on the crankpin 501, i.e., the angular displacement of the eccentric collar 502 on the crankpin 501. The eccentric collar 502 can be held at a certain angle with respect to the crankpin 501, so that the eccentric collar 502 and the crankpin 501 can revolve together around the axis C1 in response to rotation of the main shaft. When the angular displacement of the eccentric collar 502 on the crankpin 501 is adjusted, the distance of the center C3 from the axis C1, i.e., the radius of revolution of the center C3 around the axis C1, is adjusted.

A coupling ring 503 is relatively rotatably mounted on the outer circumferential surface 502 a of the eccentric collar 502 through a bearing 502. To the coupling ring 503, there are connected a plurality of radial rockable plungers 505 through respective coupling pins 504 at circumferentially equal intervals and a single radial fixed plunger 506 integral with the coupling ring 503. The apparatus also includes a cylinder casing 510 rotatable with respect to the main shaft. A plurality of cylinders 508 are rockably mounted on the cylinder casing 510 through respective supporting pins 511 at circumferentially equal intervals around the axis C1. The plungers 505, 506 are slidably fitted in radially inwardly opening cylinder bores in the respective cylinders 508.

When the cylinder casing 510, for example, is held against rotation, and the main shaft is rotated to cause the crankpin 501 and the eccentric collar 502 to revolve around the axis C1, the coupling ring 503 also revolves with the crankpin 501 and the eccentric collar 502 around the axis C1, causing the plungers 505, 506 to reciprocally move in the respective cylinders 508 for thereby drawing a working fluid such as air, oil, etc. into and discharging the working fluid out of the cylinders 508. Thus, the apparatus operates as a pump or compressor.

The rate at which the working fluid is discharged from the apparatus is proportional to the reciprocating stroke of the plungers 505, 506 in the cylinders 508 provided the main shaft rotates at a constant speed. Stated otherwise, the rate at which the working fluid is discharged from the apparatus can be varied or adjusted when the reciprocating stroke of the plungers 505, 506 is adjusted.

The reciprocating stroke of the plungers 505, 506 can be adjusted by the stroke adjusting mechanism which adjusts the angular displacement of the eccentric collar 502 with respect to the crankpin 501. Adjustment of the angle of the angular displacement of the eccentric collar 502 results in adjustment of the radius of revolution of the center C3 around the axis C1. Since the coupling ring 503 is mounted on the outer circumferential surface 502*a* of the eccentric collar 502, the reciprocating stroke of the plungers 505, 506 is adjusted when the radius of revolution of the coupling ring 503 around the axis C1 is adjusted by the stroke adjusting mechanism.

In the above variable-stroke radial-plunger-type apparatus, when the plunger stroke is adjusted by the stroke adjusting mechanism, the compression ratio of the plunger-piston assembly is simultaneously caused to vary. The compression ratio varies such that the compression ratio is maximum when the plunger stroke is maximum, and the compression ratio is minimum when the plunger stroke is minimum. Therefore, the compression ratio varies according to characteristics which are different from those which are actually required for the apparatus operating as a pump or compressor.

Such compression ratio varying characteristics will be described below with reference to FIGS. 17A, 17B and 18A, 18B of the accompanying drawings.

In FIGS. 17A and 17B, the angular displacement of the eccentric collar 502 is adjusted by the stroke adjusting mechanism to keep the axis C1, the axis C2, and the center C3 (which is also the center of the coupling ring 503) successively in line with each other. At this time, the radius of revolution of the center C3 is maximum, and so is the reciprocating stroke S of the plunger 505.

In the position shown in FIG. 17A, the plunger 505 is positioned at the top dead center. When the crankpin 501 and the eccentric collar 502 turns 180° about the axis C1, they reach the position shown in FIG. 17B, with the plunger 505 positioned at the bottom dead center. At this time, the reciprocating stroke of the plunger 505 from the top dead center to the bottom dead center is indicated by S1. The compression ratio RC1 of the plunger-piston assembly is now represented as follows:

$$RC1=(S1+D1)/D1=S1/D1+1$$

where D1 is the clearance in the cylinder 108 when the plunger 505 is at the top dead center, i.e., the distance between the upper end of the plunger 505 and the upper end of the cylinder bore in the cylinder 508 when the plunger 505 is at the top dead center.

Then, the angular displacement of the eccentric collar 502 is adjusted by the stroke adjusting mechanism to position the axis C1, the axis C2, and the center C3 as shown in FIG. 18A. The radius of revolution of the center C3 around the axis C1 is reduced, and so is the reciprocating stroke S of the plunger 505.

The plunger 505 is at the top dead center in the position shown in FIG. 18A. When the crankpin 501 and the eccentric collar 502 turns 180° about the axis C1, they reach the position shown in FIG. 18B, with the plunger 505 positioned at the bottom dead center. At this time, the reciprocating stroke of the plunger 505 from the top dead center to the bottom dead center is indicated by S2, and is smaller than the reciprocating stroke S1 shown in FIGS. 17A and 17B. When the plunger 505 is at the top dead center, a clearance D2 is left in the cylinder 508, the clearance D2 being larger than the clearance D1 shown in FIG. 17A. The compression ratio RC2 of the plunger-piston assembly is now represented as follows:

$$RC2=(S2+D2)/D2=S2/D2+1.$$

Since S1>S2 and D1<D2, the compression ratio RC1 is larger than the compression ratio RC2. In the variable-stroke radial-plunger-type apparatus, therefore, as shown in FIG. 19 of the accompanying drawings, the compression ratio RC is maximum when the plunger stroke is maximum to maximize the rate at which the working fluid is discharged, and the compression ratio RC is reduced as the plunger stroke is reduced to reduce the rate at which the working fluid is discharged.

Generally, if the working fluid is compressible, e.g., if it is air, the operation efficiency of the apparatus is higher as the compression ratio RC is higher. The efficiency of the variable-stroke radial-plunger-type apparatus is maximum when the rate of discharge of the working fluid is maximum. However, as the rate of discharge of the working fluid is reduced, the efficiency of the apparatus is also reduced.

In the case where the variable-stroke radial-plunger-type apparatus is used as an air compressor, for example, it is preferable to supply a reservoir air tank with a large amount of air even under low pressure when the reservoir tank is almost empty, and to supply the reservoir tank with a small amount of air under high pressure when the reservoir tank stores much air and has an increased inner pressure. The variable-stroke radial-plunger-type apparatus poses one problem here in that since the compression ratio is reduced as the plunger stroke is reduced to reduce the rate of discharge of air, the variable-stroke radial-plunger-type apparatus cannot supply air under high pressure when the rate of discharge of air is reduced.

SUMMARY OF THE INVENTION

In view of the aforesaid drawbacks of the conventional variable-stroke radial-plunger-type apparatus, it is an object of the present invention to provide a variable-stroke radial-plunger-type apparatus which has desired compression ratio varying characteristics when the rate of discharge of a working fluid is adjusted by adjusting the stroke of plungers.

Another object of the present invention is to provide a variable-stroke radial-plunger-type apparatus capable of operating highly efficiently with a compression ratio kept at a high value within a predetermined range of different displacements, i.e., a predetermined range of different strokes.

Still another object of the present invention is to provide a variable-stroke radial-plunger-type apparatus which can have compression ratio varying characteristics selected such that the compression ratio is maximum when plungers have a maximum stroke, i.e., when the displacement of the plungers is maximum, within a predetermined range of variable strokes, and the compression ratio is minimum when plungers have a minimum stroke within the predetermined range of variable strokes, so that the variable-stroke radial-plunger-type apparatus can suitably operate as an air compressor.

According to the present invention, there is provided a radial-plunger-type apparatus comprising a casing assembly, a main shaft relatively rotatably disposed in the casing casing assembly for rotation about a first axis and having a crankpin radially displaced off the first axis, an eccentric collar angularly movably mounted on the crankpin and having an outer circumferential surface eccentric with respect to the crankpin, a coupling ring angularly movably mounted on the outer circumferential surface of the eccentric collar, a plunger extending radially outwardly and having a radially inner end pivotally supported on the coupling ring, a cylinder having a cylinder bore, the plunger being slidably fitted in the cylinder bore through a radially inner end thereof, the cylinder being rockably attached to the casing assembly, a stroke adjusting mechanism for adjusting the angular movement of the eccentric collar on the crankpin, and a W-mechanism for positioning the coupling ring with respect to the main shaft and the casing assembly.

The W-mechanism may comprise a first internal gear coupled to the casing assembly concentrically with the main shaft, an external gear rotatably mounted on the main shaft for rotation about the crankpin and held in mesh with the first internal gear, and a second internal gear disposed concentrically with the coupling ring for rotation in unison therewith and held in mesh with the external gear, the first and second internal gears having the same number of gear teeth, the external gear having a number of gear teeth which is smaller than the number of gear teeth of the first and second internal gears.

The cylinder is rockable about a second axis with respect to the casing assembly, the plunger is angularly movable about a third axis with respect to the coupling ring, and the third axis is revolvable around a fourth axis in response to rotation of the main shaft. The components of the W-mechanism are arranged such that when the angular movement of the eccentric collar is adjusted by the stroke adjusting mechanism to maximize a reciprocating stroke of the plunger in the cylinder bore, the second axis is angularly spaced by a predetermined angle in a circumferential direction of the casing around the fist axis from a reference plane which extends through the first axis and the fourth axis.

The W-mechanism may be arranged such that when the angular movement of the eccentric collar is adjusted by the stroke adjusting mechanism to reduce the reciprocating stroke of the plunger in the cylinder bore from the maximum reciprocating stroke, a first plane which extends through the fourth axis and the first axis is moved away from the reference plane toward a second plane which extends through the second axis and the first axis.

The cylinder and the plunger slidably fitted in the cylinder bore have a variable compression ratio, the compression ratio being variable when the reciprocating stroke of the plunger is adjusted by the stroke adjusting mechanism and the first plane is moved by the W-mechanism upon adjustment of the reciprocating stroke, in such a range that the compression ratio increases as the reciprocating stroke of the plunger decreases.

The W-mechanism may comprise a first external gear coupled to the casing assembly concentrically with the main shaft, an internal gear rotatably mounted on the main shaft for rotation about the crankpin and held in mesh with the first external gear, and a second external gear disposed concentrically with the coupling ring for rotation in unison therewith and held in mesh with the internal gear, the first and second external gears having the same number of gear teeth, the internal gear having a number of gear teeth which is smaller than the number of gear teeth of the first and second external gears.

Alternatively, the W-mechanism may comprise a first sprocket coupled to the casing assembly concentrically with the main shaft, a second sprocket rotatably mounted on the main shaft for rotation about the crankpin and having a number of gear teeth different from the number of gear teeth of the first sprocket, a first chain trained around the first and second sprockets, a third sprocket disposed concentrically with the second sprocket for rotation in unison therewith and having the same number of gear teeth as the number of gear teeth of the second sprocket, a fourth sprocket disposed concentrically with the coupling ring for rotation in unison therewith and having the same number of gear teeth as the number of gear teeth of the first sprocket, and a second chain trained around the third and fourth sprockets.

According to the present invention, there is also provided a radial-plunger-type apparatus comprising a casing assembly, a main shaft relatively rotatably disposed in the casing casing assembly for rotation about a first axis and having a crankpin radially displaced off the first axis, an eccentric collar mounted on the crankpin and having an outer circumferential surface eccentric with respect to the crankpin, a coupling ring angularly movably mounted on the outer circumferential surface of the eccentric collar, a plunger extending radially outwardly and having a radially inner end pivotally supported on the coupling ring, a cylinder having a cylinder bore, the plunger being slidably fitted in the cylinder bore through a radially inner end thereof, the cylinder being rockably attached to the casing assembly, a W-mechanism having a first internal gear relatively rotatably disposed in the casing assembly concentrically with the main shaft, an external gear rotatably mounted on the main shaft for rotation about the crankpin and held in mesh with the first internal gear, and a second internal gear disposed concentrically with the coupling ring for rotation in unison therewith and held in mesh with the external gear, the first and second internal gears having the same number of gear teeth, the external gear having a number of gear teeth which is smaller than the number of gear teeth of the first and second internal gears, and a compression ratio adjusting mechanism for angularly moving the first internal gear with respect to the casing to adjust a clearance in the cylinder when the plunger is at the top dead center therein.

In the above radial-plunger-type apparatus, the cylinder is rockable about a second axis with respect to the casing assembly, the plunger is angularly movable about a third axis with respect to the coupling ring, and the third axis is revolvable around a fourth axis in response to rotation of the main shaft. The components of the W-mechanism are arranged such that when the angular movement of the eccentric collar is adjusted by the stroke adjusting mechanism to maximize a reciprocating stroke of the plunger in the cylinder bore, the second axis is angularly spaced by a predetermined angle in a circumferential direction of the casing around the fist axis from a reference plane which extends through the first axis and the fourth axis.

The collar is angularly movably mounted on the crankpin, and the radial-plunger-type apparatus further includes a stroke adjusting mechanism for adjusting the angular movement of the eccentric collar on the crankpin to adjust a stroke of the plunger, whereby the radial-plunger-type apparatus is of the variable displacement type, and an angular movement control mechanism for controlling the compression ratio adjusting mechanism to angularly move the first internal gear in relation to the adjustment of the angular movement of the eccentric collar by the stroke adjusting mechanism.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
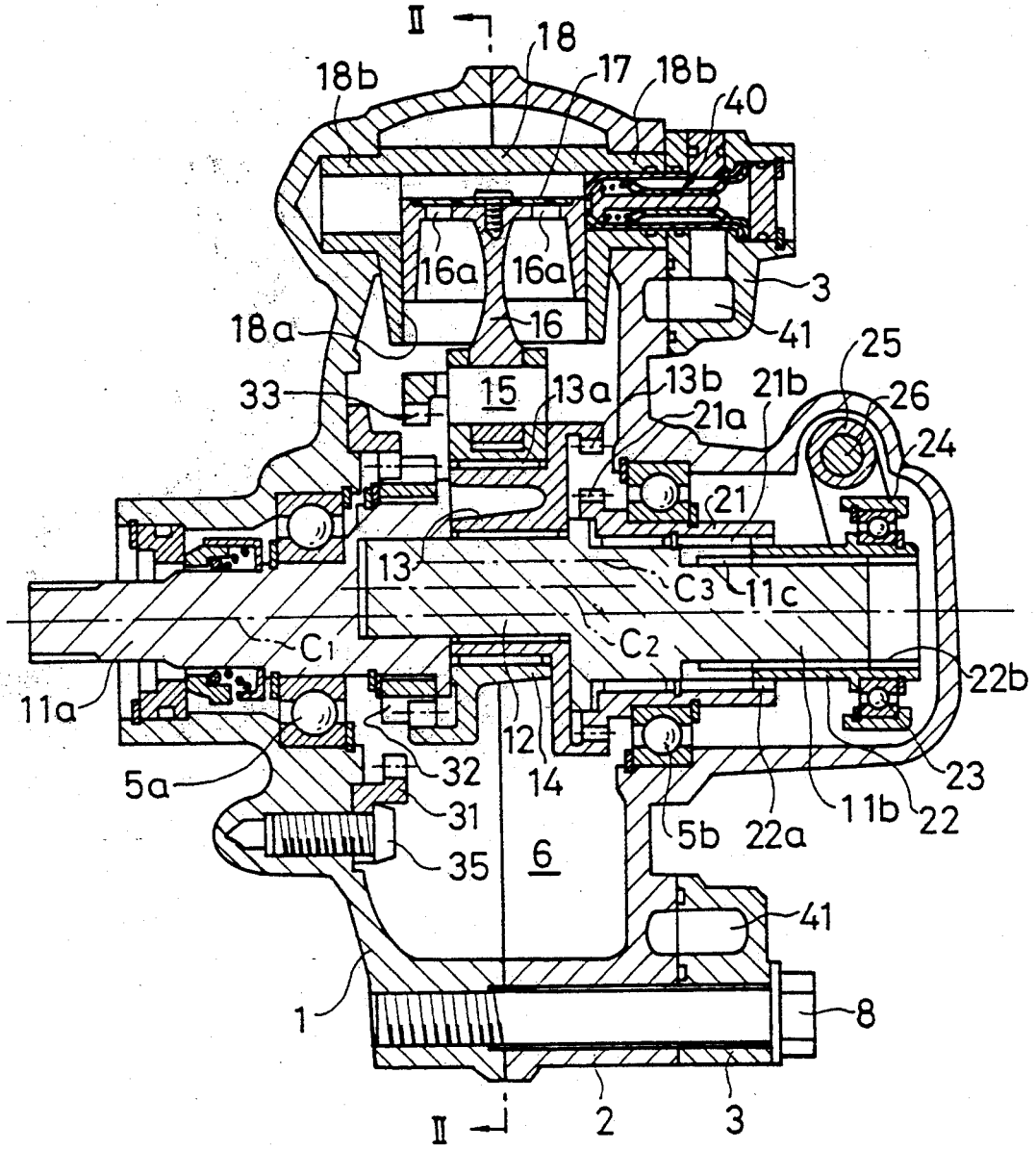
FIG. 1 is a cross-sectional view of a compressor as a variable-stroke radial-plunger-type apparatus according to a first embodiment of the present invention.
Figure 2:
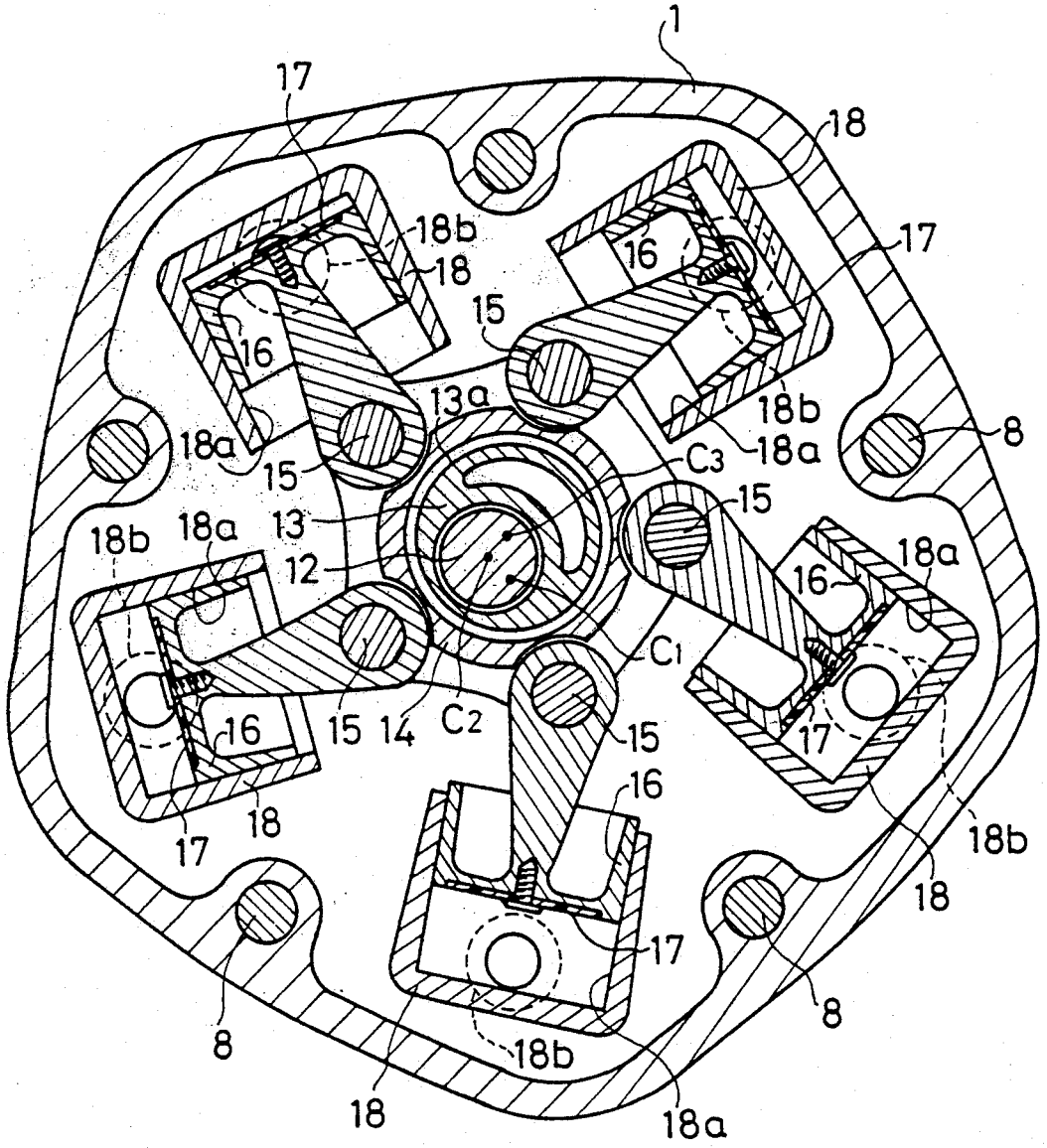
FIG. 2 is a cross-sectional view taken along line II—II of FIG. 1.

FIGS. 1 and 2 show a compressor as a variable-stroke radial-plunger-type apparatus according to a first embodiment of the present invention.

The compressor has a housing or casing assembly composed of two casings 1, 2 which are fastened to each other by bolts 8. The compressor includes a main shaft 11 extending centrally through the casings 1, 2 and relatively rotatably supported in the casings 1, 2 by bearings 5*a*, 5*b*. The casing 2, which is shown on the righthand side of FIG. 1, has a cover 3 coupled to a righthand side thereof, the cover 3 defining a discharge passage 41.

The main shaft 11 is composed of two main shaft members 11*a*, 11*b*. The main shaft member 11*a*, which is shown on the lefthand side of FIG. 1, projects outwardly to the left from the casing 1 so as to be driven by an external drive source (not shown). The lefthand main shaft member 11*a* is rotatable about a central axis C1 thereof. The main shaft member 11*b* which is shown on the righthand side of FIG. 1, has an integral crankpin 12 having a central axis C2 that is radially displaced a distance L1 from the axis C1 of the lefthand main shaft member 11. The crankpin has a tip end fitted in an eccentric hole defined in the righthand end of the lefthand main shaft member 11. In this manner, the main shaft members 11*a*, 11*b* are coupled to each other. The main shaft 11 and the crankpin 12 rotate together about the axis C1, with the axis C2 revolving around the axis C1.

On the crankpin 12, there is relatively rotatably mounted an eccentric collar 13 having a cylindrical outer circumferential surface 13*a* whose center C3 of curvature, or central axis, is radially displaced a distance L2 from the axis C2 of the crankpin 12.

A coupling ring 14 is relatively rotatably mounted on the outer circumferential surface 13*a* of the eccentric collar 13. The coupling ring 14 is therefore rotatable on the eccentric collar 13 about the axis C3 of the outer circumferential surface 13*a*.

As shown in FIG. 2, the compressor includes five cylinders 18 radially disposed around the coupling ring 14. Each of the cylinders 18 has a pair of laterally spaced trunnions 18*b* (see FIG. 1) by which the cylinder 18 is rockably supported on the casings 1, 2. The central axes of the trunnions 18*b* of the cylinders 18, about which the cylinders 18 are rockable, are positioned at the same radial distance from the axis C1 and are equally circumferentially spaced around the axis C1.

The cylinders 18 have respective cylinder bores 18*a* opening radially inwardly. Five plungers 16 are slidably fitted in the respective cylinder bores 18*a*. The plungers 16 have respective connecting rods whose radially inner ends are pivotally coupled to the coupling ring 14 by respective pins 15.

The plungers 16 in the cylinder bores 18*a* define cylinder chambers that communicate through check valves 40 disposed respectively in holes defined in the respective righthand trunnions 18*b*, with the discharge passage 41 defined between the casing 2 and the cover 3. The check valves 40 allow a working fluid such as air to flow from the cylinder chambers toward the discharge passage 41, but prevent the working fluid from flowing backwards.

Each of the plungers 16 ' s holes 16*a* defined in the radially outer end thereof and covered with a reed valve 17 attached to the outer surface of the radially outer end of the plunger. The reed valve 17 comprises a thin flexible member, which allows the working fluid to flow from a space 6 defined between the casings 1, 2 into the cylinder chamber when the reed valve 17 is flexed away from the plunger 16, but prevents the working fluid from flowing in the opposite direction.

When each plunger 16 is reciprocally moved in the cylinder bore 18*a* in response to rotation of the main shaft 11, the working fluid flows from the space 6 past the reed valve 17 into the cylinder chamber while the plunger 16 is moving from the top dead center to the bottom dead center, and the working fluid flows from the cylinder chamber through the check valve 40 into the discharge passage 41 while the plunger 16 is moving from the bottom dead center to the top dead center. In this manner, the variable-stroke radial-plunger-type apparatus operates as a compressor.

The compressor shown in FIGS. 1 and 2 has a stroke adjusting mechanism for adjusting the displacement thereof, and a W-mechanism for permitting the variable-stroke radial-plunger-type apparatus to operate as a compressor as described above.

The stroke adjusting mechanism comprises an internal gear 13*b* disposed on the righthand side of the eccentric collar 13 and concentric with the axis C2 of the crankpin 12, and a rotatable sleeve 21 and a slidable sleeve 22 which are disposed on the righthand main shaft member 11*b* of the main shaft 11 for rotation about the shaft C1. The rotatable sleeve 21 has an external gear 21*a* disposed on the lefthand end thereof which is held in mesh with the internal gear 13*b*. Upon rotation of the rotatable sleeve 21 on the righthand main shaft member 11*b*, the eccentric collar 13 is angularly moved on the crankpin 12.

The rotatable sleeve 21 has internal splines 21*b* on its inner circumferential surface which are held in mesh with external splines 22*a* on the outer circumferential surface of the slidable sleeve 22. The slidable sleeve 22 also has internal splines 22*b* on its inner circumferential surface which are held in mesh with external splines 11*c* on the righthand main shaft member 11*b*.

A shifter receiver 24 is mounted on the slidable sleeve 22 by a bearing 23, and engages a tip end of a shifter lever 25 that is angularly movably supported on a pivot shaft 26. When the shifter lever 25 is angularly moved on the pivot shaft 26, the slidable sleeve 22 is caused to slide to the left or right on the righthand main shaft member 11*b* by the shifter receiver 24.

At least one pair of the internal splines 21b of the rotatable sleeve 21 and the external splines 22a of the slidable sleeve 22, and the internal splines 22b of the slidable sleeve 22 and the external spline 11c of the righthand main shaft member 11b is in the form of a helical spline pair. Therefore, when the slidable sleeve 22 slides to the left or right on the righthand main shaft member 11b, the rotatable sleeve 21 is turned about the axis C1, angularly moving the eccentric collar 13 on the crankpin 12.

The angular movement of the eccentric collar 13 is effective to adjust the reciprocating stroke S of the plungers 16.

Figure 3:
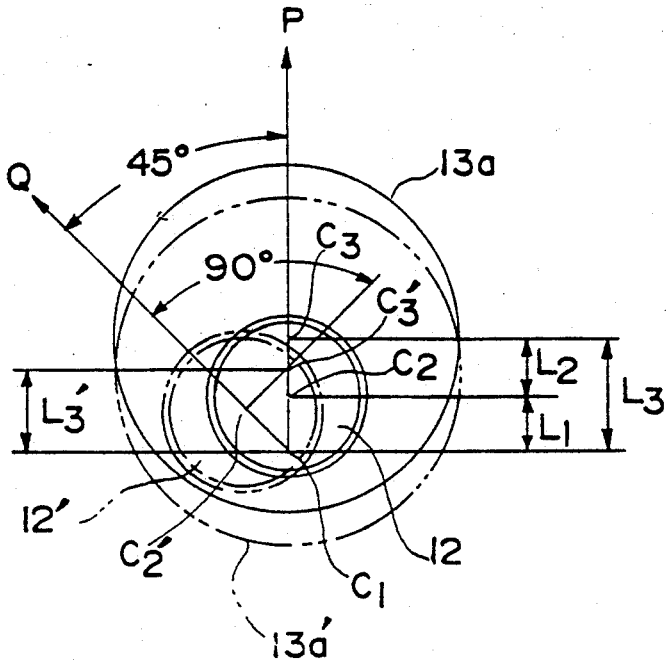
FIG. 3 is a diagram showing the positional relationship between rotational members of the compressor shown in FIG. 1 at the time the plunger stroke is adjusted by a stroke adjusting mechanism.

More specifically, as shown in FIG. 3, it is assumed that the eccentric collar 13 is angularly moved from a position in which the axis C1 of the main shaft 11, the axis C2 of the crankpin 12, and the center C3 of the outer circumferential surface 13a of the eccentric collar 13 (i.e., the center of the coupling ring 14) are aligned with each other in the direction indicated by the arrow P. The axis C2 is displaced a distance L1 from the axis C1, and the center C3 is displaced a distance L2 from the axis C2. At this time, the center C3 is displaced a distance L3 from the axis C1.

When the main shaft 11 is rotated about its own axis C1 from the position in which the axes C1, C2, C3 are aligned with each other, the distance which the outer circumferential surface 13a of the eccentric collar 13 moves in the direction P is twice the distance L3 by which the center C3 is displaced from the axis C1 (=2L3). Therefore, the coupling ring 14 also moves the distance 2L3, and the reciprocating stroke S of the plunger 16 is determined depending on such distance 2L3.

Now it is assumed that the eccentric collar 13 is turned to the position indicated by the two-dot-and-dash lines. To keep the center C3 stay on the direction P, the main shaft 11 is turned 45° counterclockwise, turning the eccentric collar 13 counterclockwise on the crankpin 12 by 90°.

The crankpin 12 moves to a position 12' with its axis C2 to a position C2'. At the same time, the outer circumferential surface 13a of the eccentric collar 13 moves to a position 13a', with the center C3 to a position C3'. As a result, the center C3' of the outer circumferential surface 13a thus moved is displaced a distance L3' (<L3) from the axis C1 of the main shaft 1.

When the main shaft 11 is rotated under such a condition, therefore, the outer circumferential surface 13a' moves in the direction P by a distance 2L3' which is twice the distance L3' between the center C3' and the axis C1. Accordingly, the distance which the coupling ring 14 moves is also reduced as it is 2L3', and the reciprocating stroke S of the plunger 16 is also reduced.

For reciprocating the plunger 16 when the eccentric collar 13 is rotated with the main shaft 11 after the stroke of the plungers 16 has been adjusted, it is necessary to revolve the coupling ring 14 around the main shaft 1 without rotating the coupling ring 14 about its own axis. The W-mechanism is employed to allow the coupling ring 14 to effect such a revolving movement without rotation about its own axis.

The W-mechanism comprises a first internal gear 31 coupled to the casing 1 concentrically with the axis C1 of the main shaft 11, an external gear 32 rotatably mounted on the lefthand main shaft member 11a concentrically with the axis C2 of the crankpin 12, and a second internal gear 33 integral with the coupling ring 14 concentrically with the center C3 (which is also the central axis of the coupling ring 14) of the outer circumferential surface 13a of the eccentric collar 13.

The number Z1 of gear teeth of the first internal gear 31 and the number Z3 of gear teeth of the second internal gear 33 are equal to each other, and the number Z2 of gear teeth of the external gear 32 is smaller than the numbers Z1, Z3 of gear teeth of the internal gears 31, 33. The first internal gear 31 is held in mesh with the external gear 32, which is in turn held in mesh with the second internal gear 33.

Figure 4:
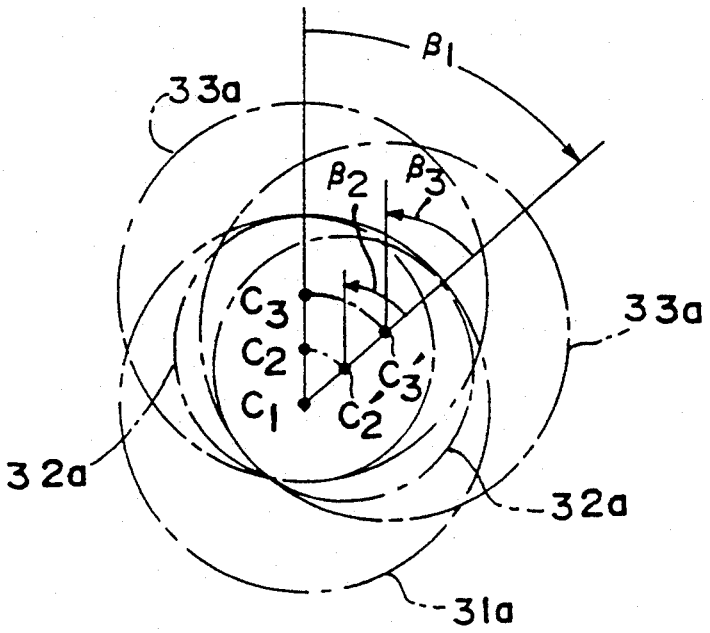
FIG. 4 is a schematic diagram illustrative of the manner in which a W-mechanism of the compressor operates.

Operation of the W-mechanism will be described below with reference to FIG. 4.

In the illustrated compressor, the main shaft 11 is driven to rotate about its own axis C1. Since the eccentric collar 13 is operatively coupled to the main shaft 11 through the stroke adjusting mechanism, when the main shaft 11 rotates, the axis of the crankpin 12, i.e., the axis C2 of the external gear 22, and the axis of the outer circumferential surface 13a of the eccentric collar 13, i.e., the axis C3 of the second internal gear 33, revolve around the axis C1 of the main shaft 11. If the main shaft 11 is angularly moved through an angle $\beta 1$, for example, as shown in FIG. 4, the axes C2, C3 revolve through the angle $\beta 1$ around the axis C1.

Because the first internal gear 21 is secured to the casing 1, when the axis C2 of the external gear 32 is turned through the angle $\beta 1$, the external gear 32 is angularly moved backwards through an angle $\beta 2$. The numbers of gear teeth of the gears 31, 32 and their angular displacement are inversely proportional to each other. Thus, the angle $\beta 2$ is given as follows:

$$\beta 2 = -Z1/Z2 \times \beta 1 \quad (1).$$

When the external gear 32 is turned through the angle $\beta 2$, the second internal gear 33 is angularly moved through an angle $\beta 3$ that is expressed, using the equation (1) above, by:

$$\beta 3 = Z2/Z3 \times \beta 2 = -Z1/Z3 \times \beta 1 \quad (2).$$

The rotational angle $\beta 4$ (absolute rotational angle) of the second internal gear 33 with respect to the first internal gear 31 is the sum of the angle $\beta 1$ and the angle $\beta 3$. Therefore, the rotational angle $\beta 4$ is given by:

$$\beta 4 = \beta 1 + \beta 3 = (Z3 - Z1)/Z3 \times \beta 1 \quad (3).$$

The equation (3) indicates that if the numbers Z1, Z3 of gear teeth of the first and second internal gears 31, 33 are equal to each other, then the rotational angle $\beta 4$ of the second internal gear 33 is zero, and the second internal gear 33 does not rotate about its own axis.

As described above, when the main shaft 11 is rotated with respect to the fixed casings 1, 2 of the compressor, the W-mechanism serves to revolve the coupling ring 14 around the main shaft 11 while preventing the coupling ring 14 from rotating about its own axis.

Figure 5:
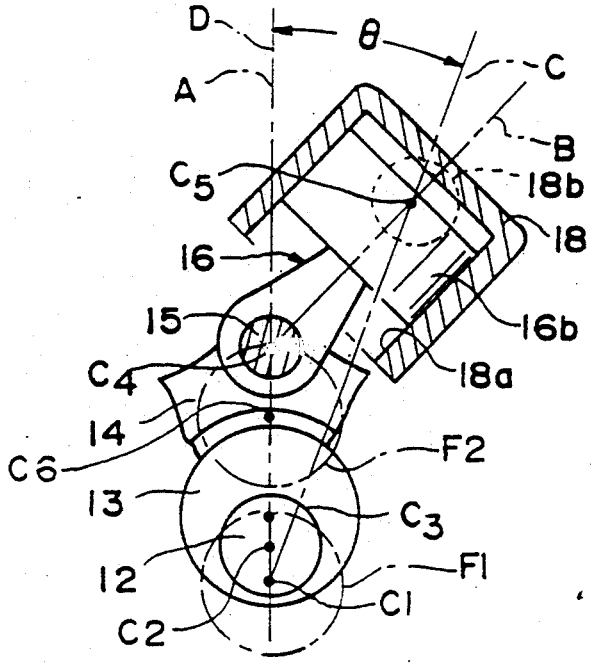
FIG. 5 is a cross-sectional view showing the positional relationship between a plunger and a cylinder of the compressor.

Inasmuch as the coupling ring 14 is rotatably disposed on the outer circumferential surface 13a of the eccentric collar 13, the revolution of the coupling ring 14 in response to the rotation of the main shaft 11 is identical to the revolution of the center C3 of the outer circumferential surface 13a of the eccentric collar 13, and takes place along a circular path indicated by F1 in FIG. 5.

Likewise, as shown in FIG. 5, the axis C4 of the pin 15 by which each of the plungers 16 is pivotally coupled to the coupling ring 14 effects the same revolution as that of the coupling ring 14, the revolution taking place along a circular path indicated by F2 around a center C6. Thus, the plunger 16 reciprocally moves in each of the cylinders 18 which are rockably coupled to the casings 1, 2.

As shown in FIG. 5, the axis C5 about which the cylinder 18 is rockable with respect to the casings 1, 2 is positioned such that when the angular displacement of the eccentric collar 13 is adjusted by the stroke adjusting mechanism to maximize the reciprocating stroke of the plunger 16, i.e., to align the axis C1, the axis C2, and the center C3 with each other as shown, a straight line (or plane) C extending through the axis C5 and the axis C1 is inclined at an angle $\theta$ to a reference straight line (or plane) A extending through the center C6 around which the axis C4 revolves and the axis C1, in the circumferential direction of the casings 1, 2. The angle $\theta$ will be referred to as "cylinder deviation angle".

When the angular displacement of the eccentric collar 13 is adjusted by the stroke adjusting mechanism to adjust the plunger stroke from the illustrated position, the coupling ring 14 is rotated, and the center C6 moves away from the reference plane A toward the plane C. Therefore, upon the stroke adjustment, the W-mechanism operates to displace a straight line (or plane) D extending through the axis C4 and the axis C1 away from the plane A toward the plane C.

It can be understood from the above explanation that the reference plane A is a fixed plane interconnecting the center C6 and the axis C1 when the plunger stroke is maximum, and the plane D is a movable plane which can be moved when the W-mechanism operates upon stroke adjustment. When the plunger stroke is maximum, the planes A, B are superposed on each other.

The angle of the plane D with respect to the reference plane A will be referred to as a "moving angle $\delta$". The moving angle $\delta$ corresponds to the angular displacement of the coupling ring 14, and varies such that it becomes greater the plunger stroke is adjusted as described above.

Figure 6:
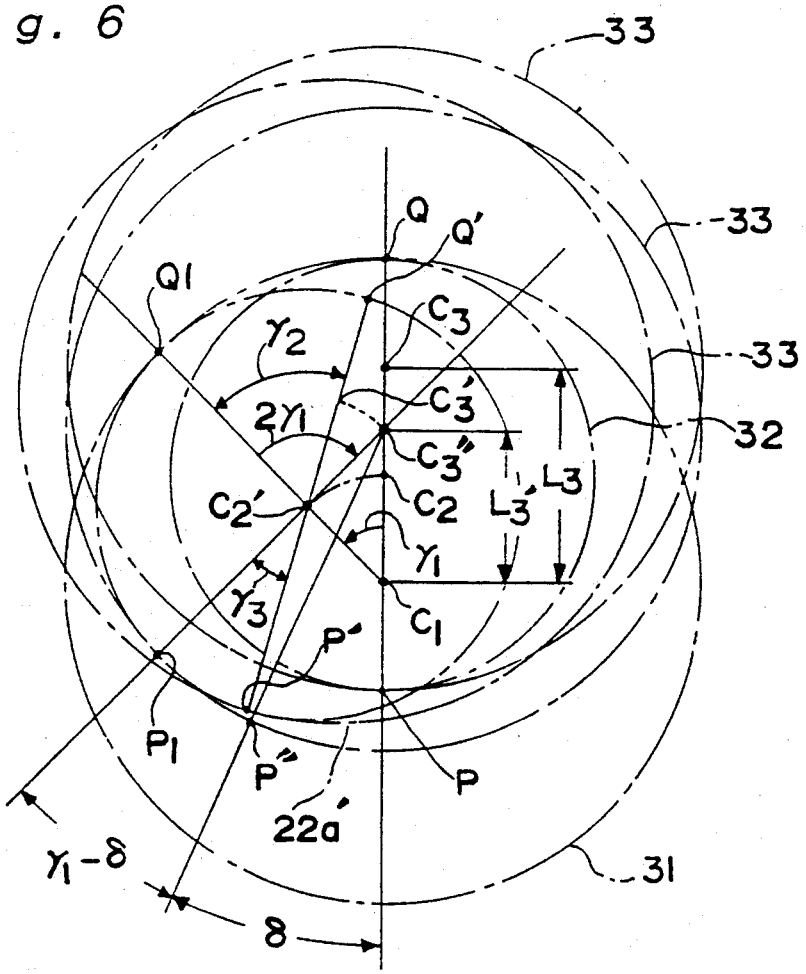
FIG. 6 is a schematic diagram showing the manner in which the angular displacement of a coupling ring is varied by the W-mechanism when the plunger stroke is adjusted by the stroke adjusting mechanism.

More specifically, as shown in FIG. 6, it is assumed that the shifter lever 25 is turned to angularly move the eccentric collar 13 through an angle $2\gamma 1$ with respect to the crankpin 12 from the position in which the axes C1, C2, C3 are aligned with each other for the maximum plunger stroke.

The axis C3 angularly moves through the angle $2\gamma 1$ with respect to the axis C2. When the axis is turned backwards about the axis C1 through an angle $\gamma 1$, the axis C3 moves to a position C3'' without angular movement, and the distance which the axis C3 of the coupling ring 14 is displaced from the axis C1 for giving the plunger 16 a predetermined stroke varies from L3 to L3'. The distance L1 is equal to the distance L2.

The angular displacement of the second internal gear 33, i.e., the coupling ring 14, or the moving angle $\delta$, is determined as follows:

First, when the axis C2 of the external gear 32 moves to a position C2' through the angle $\gamma 1$ while being held in mesh with the first internal gear 31 coupled to the casings 1, 2, a point Q where the gears 31, 32 mesh with each other moves. At this time, the axis C2 of the external gear 32 moves to a position indicated by C2', and the meshing point Q moves to a position indicated by Q1. The angle $\gamma 2$ through which the external gear 32 is angularly moved is an angle subtended by an arc between a point Q' corresponding to the original meshing point and the meshing point Q1. Since the length of the arc Q'Q1 is equal to the length of the arc QQ1, the relationship $Z1 \times \gamma 1 = Z2 \times \gamma 2$ is satisfied, and the angle $\gamma 2$ is given by:

$$\gamma 2 = Z1/Z2 \times \gamma 1 \quad (4).$$

At this time, the axis C3 has moved to a position indicated by C3', and a point P where the external gear 32 and the second internal gear 33 mesh with each other has moved to a point indicated by P'.

Then, the second internal gear 33 is turned about the axis C2', with its axis C3' moving to a position indicated by C3'', whereupon the process of reducing the interaxial distance L3 to L3' is completed. The point P' where the external gear 32 and the second internal gear 33 mesh with each other moves to a point P1. A point corresponding to the meshing point P' moves to a point P''. Because the first meshing point P on the second internal gear 33 where it meshes with the external gear 32 moves eventually to the point P'', the angle through which the phase of the second internal gear 33 varies is represented by an angle $\delta$ about the axis C3'' from the point P to the point P''.

At this time, the distance over which the external gear 32 is turned, i.e., an arc P'P1, is equal to the distance over which the second internal gear 33 is turned, i.e., an arc P''P1. Since the angle through which the external gear 32 is turned is $\gamma 3$ ($=2\gamma 1-\gamma 2$) and the angle through which the second internal gear 33 is turned is ($\gamma 1 - \delta$), the following equation is satisfied:

$$Z2(2\gamma 1-\gamma 2) = Z3(\gamma 1-\delta) \quad (5).$$

Substituting the equation (4) and the relationship $Z1=Z3$ in the equation (5), the following equation is obtained:

$$\delta = (Z1-Z2)/Z1 \times 2\gamma 1 \quad (6).$$

The equation (6) indicates the relationship between the rotational angle $\delta$ (the angle through which the phase varies) of the second internal gear 33 and the rotational angle ($=2\gamma 1$) of the eccentric collar 13 for stroke adjustment. The rotational angle $\delta$ of the second internal gear 33 is the same as the angular displacement of the coupling ring 14, i.e., the moving angle. It can be seen from the equation (6) that when the eccentric collar 13 is angularly moved for stroke adjustment, the coupling ring 14 is angularly moved, and the center C6 around which the axis C4 revolves moves.

Now, the numbers Z1, Z3 of gear teeth of the first and second internal gears 31, 33 are selected to be $Z1=Z3=49$. the number Z2 of gear teeth of the external gear 32 is selected to be $Z2=40$, and the distance L1, L2 are selected to be $L1=L2=4.5$ mm. The rotational angles $\gamma 1$, $\delta$ and the distance L3 (referred to as "stroke radius") from the axis C1 to the axis C3 are related to each other for different values as indicated by the following table:

TABLE

| $\gamma 1$ | $\delta$ | L3 |
|---|---|---|
| 0° | 0° | 9.0 mm |
| 22.5° | 8.1° | 8.3 mm |
| 45.0° | 16.2° | 6.4 mm |
| 67.5° | 24.3° | 3.4 mm |

TABLE-continued

| γ1 | δ | L3 |
|---|---|---|
| 78.8° | 28.4° | 1.8 mm |
| 90° | 32.4° | 0.0 mm |

The rotational angle γ1 is the angle through which the axis C2 is angularly moved with respect to the axis C1, and the rotational angle of the eccentric collar 13 on the crankpin 12 at this time is 2γ1. Therefore, the stroke radius L3 is maximum (9.0 mm) when the rotational angle γ1 is γ1=0°. When the rotational angle γ1 is γ1=90°, the rotational angle of the eccentric collar 13 is 180°, the axis C3 is superposed on the axis C1, and the stroke radius L3 is minimum (0 mm).

As shown in the table, when the eccentric collar 13 is turned from 0° to 180° to vary the stroke radius L3 from the maximum value to the minimum value, the coupling ring 14 is turned 32.4°, and the angle of the plane D with respect to the reference plane A, i.e., the moving angle δ, also varies from 0° to 32.4°.

Since the moving angle δ is minimum (=0°) when the stroke radius L3 is maximum, becomes larger when the stroke radius L3 is smaller, and is maximum when the stroke radius L3 is minimum, the axis C5 about which the cylinder 18 is rockable is positioned such that the angle of the plane C with respect to the reference plane A, i.e., the cylinder deviation angle θ, is θ=32.4°. When the stroke radius L3 is minimum, the moving angle δ is δ=32.4°, and the plane D is superposed on the plane C.

As described above, the moving angle δ varies as the plunger stroke is adjusted. The difference between compression ratios RC when the plane D is positioned in superposed relationship to the reference plane A for the maximum plunger stroke and when the plane D is positioned in superposed relationship to the plane C for the minimum plunger stroke will be considered below on the assumption that no W-mechanism is employed and the plunger stroke remains constant.

Figure 7A:
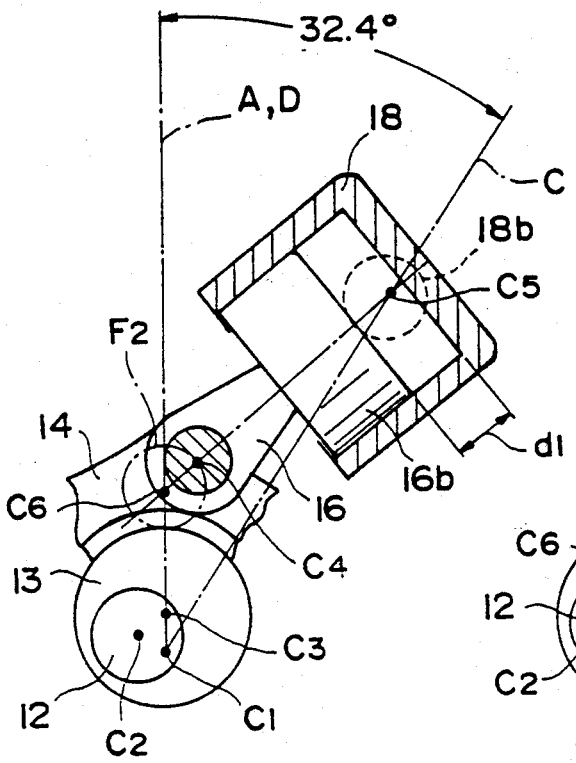
FIGS. 7A and 7B are cross-sectional views showing how the clearance in a cylinder varies when the positions of various axes are varied without plunger stroke adjustment.
Figure 7B:
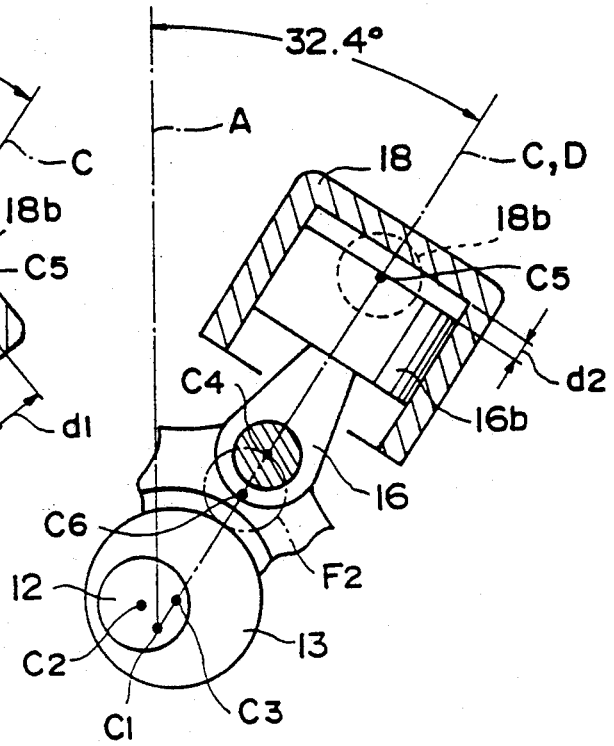

FIG. 7A shows the positions of the parts when the plane D is positioned in superposed relationship to the reference plane A for the maximum plunger stroke, and FIG. 7B shows the positions of the parts when the plane D is positioned in superposed relationship to the plane C for the minimum plunger stroke.

In FIG. 7A, the axis C1 of the main shaft 11 and the center C6 around which the axis C4 revolves are lined up on the reference plane A, and hence the clearance dl in the cylinder 18 is maximum.

In FIG. 7B, the axis C1 and the center C6 are superposed on the plane C, and the plane D is angularly displaced 32.4° from the reference plane A in the circumferential direction. Inasmuch as the distance from the axis C1 to the axis C5 remains unchanged and the length of the plunger 16 also remains unchanged, the clearance in the cylinder 18 is reduced to d2 (>d1) from the clearance d1 shown in FIG. 7A. Consequently, the plunger stroke does not vary. The compression ratio RC is minimum when the parts are positioned as shown in FIG. 7A, and maximum when they are positioned as shown in FIG. 7B.

In the above arrangement, the stroke radius L3 is constant, and the compression ratio RC is varied when the position of the plane D is varied. Actually, however, the position of the plane D is varied upon operation of the W-mechanism operates when the angular displacement of the eccentric collar 13 is varied for stroke adjustment, and there is no such a situation in which the position of the plane D is varied while the stroke radius L3 is constant.

Figure 9:
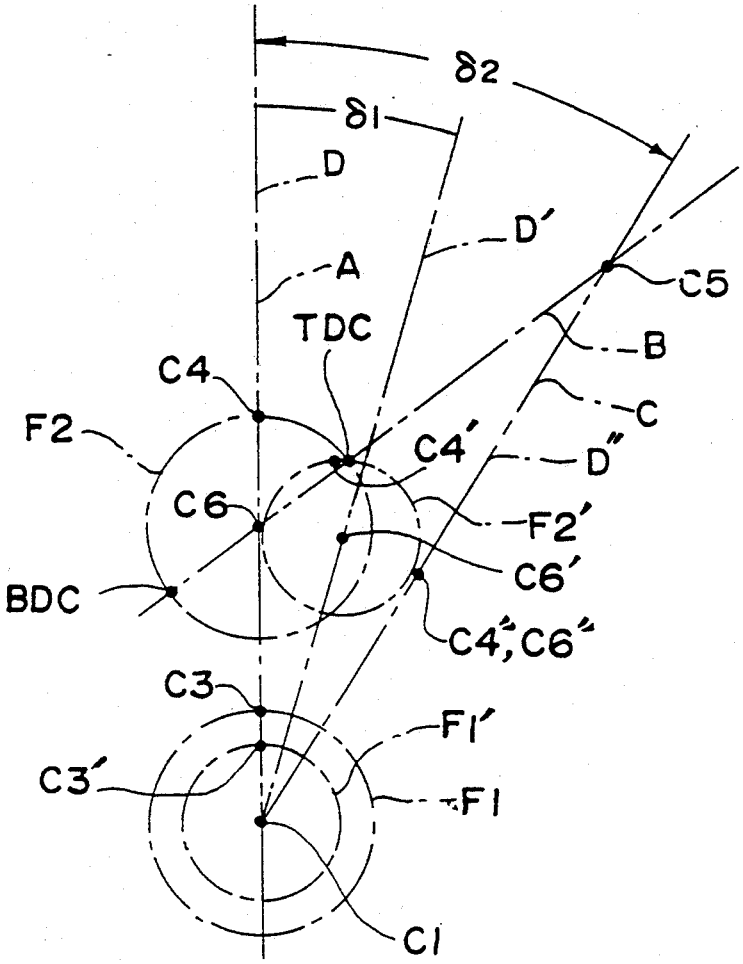
FIG. 9 is a schematic diagram showing how the positions of axes vary when the plunger stroke is adjusted.

Changes in the positions of the various axes at the time the rotational angle +65γ1 of the axis C2 with respect to the axis C1 is varied as shown in the table above will be described below with reference to FIG. 9.

As described above, the moving angle δ is 0° (minimum) when the stroke of the plunger 16 is maximized by the stroke adjusting mechanism, and is 32.4° (maximum) when the stroke of the plunger 16 is minimized by the stroke adjusting mechanism.

When the stroke of the plunger 16 is maximized by the stroke adjusting mechanism, the center C3 of the outer circumferential surface 13a of the eccentric collar 13 is most spaced from the axis C1. As shown in the table, the stroke radius L3 is of a maximum value of L3=9.0 mm, and when the main shaft 11 is rotated, the center C3 revolves along the path F1. Therefore, the axis C4 of the pin 15 by which the plunger 16 is pivotally coupled to the coupling ring 14 revolves along a circle whose radius is maximum or the same as the stroke radius L3. The axis C4 revolves along the circular path F2 whose center is C6. The center C6 and the axis C1 are interconnected by the reference plane A at this time. The cylinder 18 is rockably supported by the casings 1, 2 such that the axis C5 about which the cylinder 18 is rockable is at a position which is angularly displaced from the reference plane A by the cylinder deviation angle θ (=32.4°).

As described above, when the axis C4 moves along the path F2, the plunger 16 reciprocally moves in the cylinder 18. The plunger 16 reaches the top dead center at a point TDC of intersection between the path F2 and a straight line B which extends through the center C6 and the axis C5, and reaches the bottom dead center at another point BDC of intersection between the path F2 and the straight line B. The reciprocating stroke of the plunger 16 in the cylinder 18 is twice the radius of the revolving circle of the axis C4 (=the stroke radius L3).

When the eccentric collar 13 is turned 90° by the stroke adjusting mechanism, i.e., when the rotational angle γ is γ=45°, the moving angle δ1 becomes δ1=16.2° as shown in the table. The center of the outer circumferential surface 13a of the eccentric collar 13 moves to a position indicated by C3', and the stroke radius L3 becomes L3=6.4 mm, which is smaller than the above maximum stroke. In FIG. 9, when the eccentric collar 13 is turned 90° by the stroke adjusting mechanism, the coupling ring 14 is turned clockwise, moving the axis C4 to a position indicated by C4'.

Therefore, upon rotation of the main shaft 11, the axis C3' revolves along a path F1', and the axis C4' revolves along a path F2' which has a center C6'. The moving angle δ'through which a plane D' interconnecting the center C6' and the axis C1 is angularly moved from the reference plane A is δ1=16.2°.

Thereafter, when the eccentric collar 13 is further turned 90° by the stroke adjusting mechanism, i.e., when the rotational angle γ is γ=90°, the moving angle δ2 becomes δ=32.4° as shown in the table. The center of the outer circumferential surface 13a of the eccentric collar 13 is superposed on the axis C1, and the stroke radius L3 becomes L3=0 mm, which is minimum. With the eccentric collar 13 being thus turned, the coupling ring 14 is further turned clockwise, and the axis C4 moves to a position indicated by C4''. Since the stroke radius L3 is L3=0 mm, the axis C4'' remains in the same position even when the main shaft 11 is rotated. The center C6" of revolution is aligned with the axis C4", and the moving angle δ2 becomes δ2=32.4°.

Figure 17A:
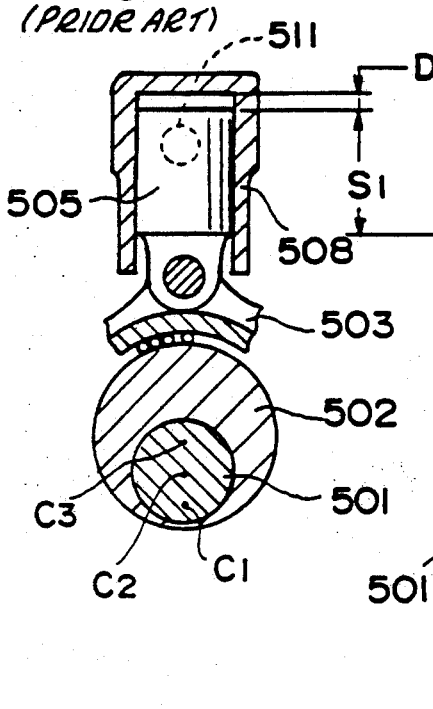
Fig. 17A (PRIOR ART)
FIGS. 17A and 17B are cross-sectional views showing the manner in which a plunger moves over a maximum stroke in the conventional variable-stroke radial-plunger-type apparatus shown in FIG. 16.
Figure 17B:
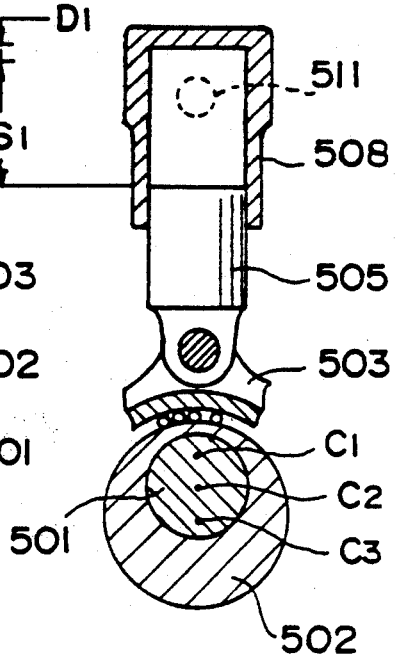
Fig. 17B (PRIOR ART)
Figure 18A:
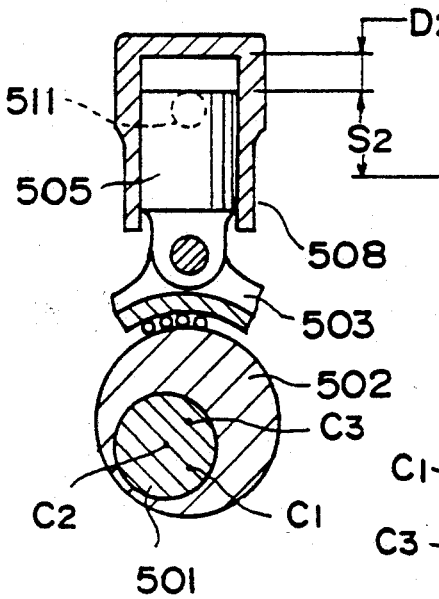
Fig. 18A (PRIOR ART)
FIGS. 18A and 18B are cross-sectional views showing the manner in which the plunger moves over a medium stroke in the conventional variable-stroke radial-plunger-type apparatus shown in FIG. 16.
Figure 18B:
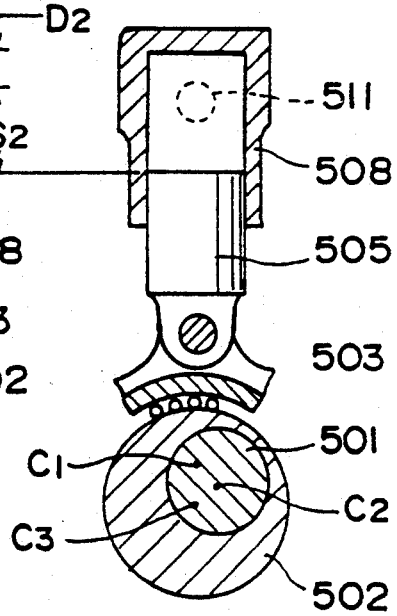
Fig. 18B (PRIOR ART)

In this compressor, since the moving angle δ is minimum when the plunger stroke is maximum, and is maximum when the plunger stroke is minimum, the compression ratio can be varied according to desired characteristics based on the compression ratio varying characteristics depending on stroke changes as described with reference to FIGS. 17A and 17B, and the compression ratio varying characteristics depending on positional changes of the plane D as described with reference to FIGS. 7A and 7B. According to the illustrated embodiment, the compression ratio is varied according to the characteristics shown in FIG. 8.

Figure 8:
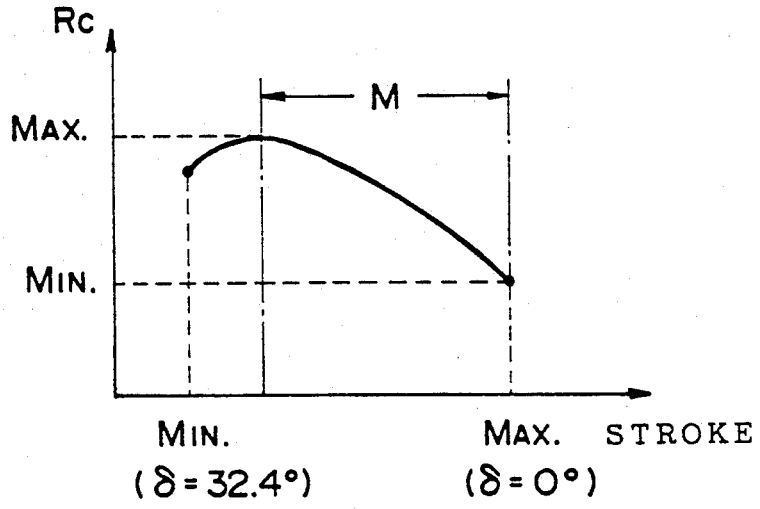
FIG. 8 is a graph showing how a compression ratio varies when the plunger stroke is varied.

When the compressor is used in a stroke range indicated by M in FIG. 8, the compression ratio may be smaller when the plunger stroke is maximum in the stroke range M and larger when the plunger stroke is minimum in the stroke range M. If the compressor is used as an air compressor, then it offers the following advantages:

If a reservoir tank used in combination with the compressor is empty when the compressor starts to operate, then it is desirable that a large amount of air be supplied to the compressor even under low pressure. In this case, a large amount of air is supplied from the compressor with the plunger stroke being maximum. As the reservoir tank is supplied with more air and its internal pressure is increased, air is no longer required to be supplied in a large amount, but no air can be supplied to the reservoir tank unless under high pressure. Therefore, when the internal pressure of the reservoir tank is progressively increased, the plunger stroke is progressively reduced to increase the compression ratio.

The compression ratio varying characteristics depending on the stroke adjustment differ according to the dimensions of the parts used, the stroke adjusting mechanism, and the W-mechanism. It is therefore possible to keep the compression ratio substantially constant over a predetermined stroke range. With such compression ratio characteristics, the compressor can be operated with a high compression ratio maintained at all times over a given stroke range, and hence with a high efficiency at all times.

In the above embodiment, when the plunger has a minimum stroke, the moving angle δ is 32.4° and the plane D is superposed on the plane C. However, when the plunger has a minimum stroke, the moving angle δ and the cylinder deviation angle θ may be selected to be of any desired values.

The W-mechanism is composed of the first and second internal gears 31, 33 and the single external gear 32 in the above arrangement. However, the W-mechanism is not limited to such a structure. According to one modification, the W-mechanism may comprise a first external gear coupled to the casings 1, 2 and having external gear teeth concentric with the axis C1 of the main shaft, an internal gear rotatably mounted on the main shaft 11 and having internal gear teeth concentric with the axis C2 of the crankpin 12, and a second external gear integral with the coupling ring 13 and having external gear teeth concentric with the center C3 of the outer circumferential surface 13*a* of the eccentric collar 13.

In the modified W-mechanism, the numbers of gear teeth of the first and second external gears are equal to each other, and the number of gear teeth of the internal gear is larger than the numbers of gear teeth of the first and second external gears. The first external gear is held in mesh with the internal gear, which is in turn held in mesh with the second external gear. The modified W-mechanism operates in the same manner as the W-mechanism in the illustrated embodiment.

In the above embodiment, the W-mechanism comprises a combination of gears. However, W-mechanisms may comprise chains and sprockets, as shown in FIGS. 10 and 11.

Figure 10:
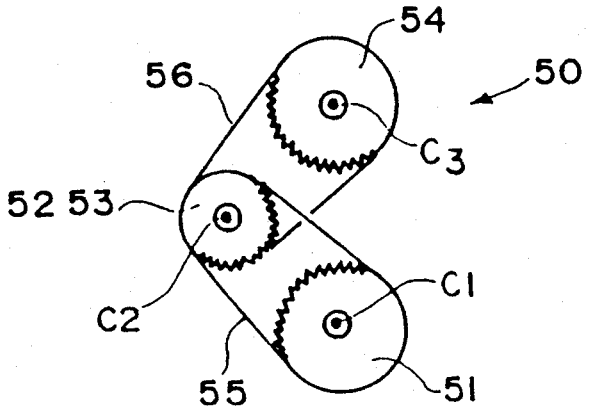
FIG. 10 is a view of a W-mechanism employing chains.

In FIG. 10, a W-mechanism 50 comprises a first sprocket 51 coupled to casings 1, 2, and disposed on a main shaft C1, a second sprocket 52 rotatably mounted on a supplementary shaft C2, a first chain 55 trained around the sprockets 51, 52, a third sprocket 53 coupled to the second sprocket 52 in juxtaposed relationship thereto, a fourth sprocket 54 rotatably mounted on an auxiliary shaft C3, and a second chain trained around the sprockets 53, 54.

Figure 11:
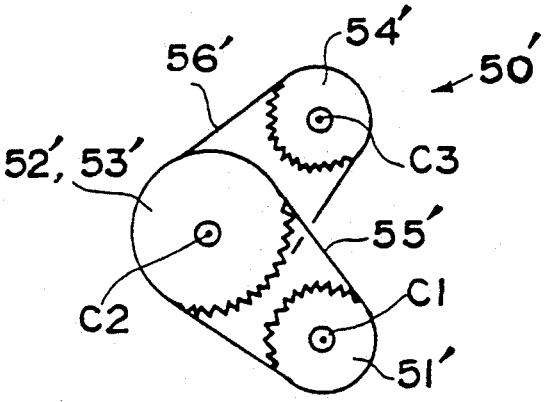
FIG. 11 is a view of another W-mechanism employing chains.

In FIG. 11, similarly, a W-mechanism 50' comprises a first sprocket 51' coupled to casings 1, 2, and disposed on a main shaft C1, a second sprocket 52' rotatably mounted on a supplementary shaft C2, a first chain 55' trained around the sprockets 51', 52', a third sprocket 53' coupled to the second sprocket 52' in juxtaposed relationship thereto, a fourth sprocket 54' rotatably mounted on an auxiliary shaft C3, and a second chain trained around the sprockets 53', 54'.

In each of the W-mechanisms 50, 50' shown respectively in FIGS. 10 and 11, the distance between the main shaft C1 and the auxiliary shaft C3, and the distance between the supplementary shaft C2 and the auxiliary shaft C3 are constant, and the position of the supplementary shaft C2 is varied to vary the distance (i.e., the stroke radius) between the main shaft C1 and the auxiliary shaft C3.

In FIG. 10, the numbers of gear teeth of the first and fourth sprockets 51, 54 are the same as each other, and the numbers of teeth of the second and third sprockets 52, 53 are the same as each other. The numbers of gear teeth of the first and fourth sprockets 51, 54 are larger than the the numbers of teeth of the second and third sprockets 52, 53.

In FIG. 11, the numbers of gear teeth of the first and fourth sprockets 51', 54' are the same as each other, and the numbers of teeth of the second and third sprockets 52', 53' are the same as each other. The numbers of gear teeth of the first and fourth sprockets 51', 54' are smaller than the the numbers of teeth of the second and third sprockets 52', 53'.

Figure 12:
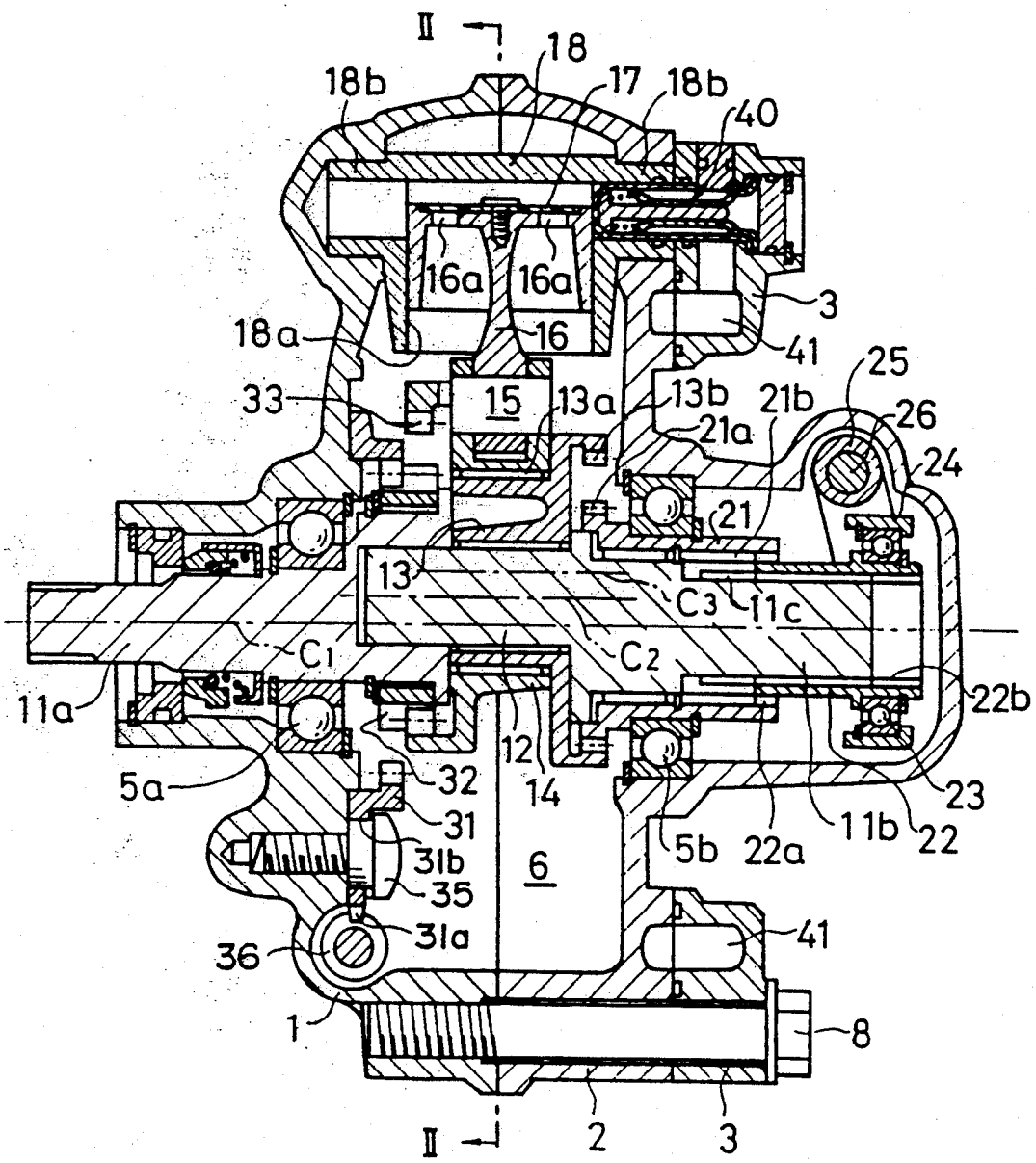
FIG. 12 is a cross-sectional view of a compressor as a variable-stroke radial-plunger-type apparatus according to a second embodiment of the present invention.

FIG. 12 shows show a compressor as a variable-stroke radial-plunger-type apparatus according to a second embodiment of the present invention.

The variable-stroke radial-plunger-type compressor shown in FIG. 12 differs from the compressor shown in FIGS. 1 and 2 only with respect to the structure of a W-mechanism. The other structural details of the compressor shown in FIG. 12 are the same as those of the compressor shown in FIGS. 1 and 2. Those parts shown in FIG. 12 which are identical to those shown in FIGS. 1 and 2 are denoted by identical reference characters, and will not be described in detail below.

The W-mechanism of the compressor shown in FIG. 12 comprises a first internal gear 31 coupled to the casing 1 concentrically with the axis C1 of the main shaft 11 for rotation about the axis C1, an external gear 32 rotatably mounted on the lefthand main shaft member 11*a* concentrically with the axis C2 of the crankpin 12, and a second internal gear 33 integral with the coupling ring 14 concentrically with the center C3 (which is also the central axis of the coupling ring 14) of the outer circumferential surface 13*a* of the eccentric collar 13.

The number Z1 of gear teeth of the first internal gear 31 and the number Z3 of gear teeth of the second internal gear 33 are equal to each other, and the number Z2 of gear teeth of the external gear 32 is smaller than the numbers Z1, Z3 of gear teeth of the internal gears 31, 33. The first internal gear 31 is held in mesh with the external gear 32, which is in turn held in mesh with the second internal gear 33.

The first internal gear 31 has an oblong hole 31*b* defined therein and extending in the circumferential direction. The first internal gear 31 is fastened to the casing 1 by a bolt 35 that is inserted through the oblong hole 31*b*. The bolt 35 loosely fastens the first internal gear 31, so that the first internal gear 31 can be angularly moved with respect to the casing 1 while the bolt 35 is relatively moving in the oblong hole 31*b*. The first internal gear 31 has a worm gear 31*a* on a portion of its outer circumferential edge, the worm gear 31*a* meshing with a worm pinion 36 mounted in the casing 1. When the worm pinion 36 is rotated about its own axis by an external drive source, therefore, the first internal gear 31 can be angularly moved about the axis C1.

In the compressor shown in FIGS. 1 and 2, the first internal gear 31 of the W-mechanism is fixed to the casing 1. In the compressor shown in FIG. 12, however, the first internal gear 31 can be angularly moved with respect to the casing 1 when the worm pinion 36 is rotated by the external drive source, as described above. The compression ratio varying characteristics depending on the angular movement of the first internal gear 31 will be described below.

It is assumed that the first internal gear 31 is turned with the stroke of the plunger 16 being maximized by the stroke adjusting mechanism.

With the maximum plunger stroke, the axis C4 of the pin by which the plunger 16 is pivotally coupled to the coupling ring 14 revolves along the circular path F2. The first internal gear 31 is now turned from the position in which the circular path F2 has its center located at C6.

When the first internal gear 31 is thus turned, the center C6 moves along a circle about the axis C1 to a position C61. Therefore, the reference plane A moves to a position A1, and the cylinder deviation angle $\theta$ becomes $\theta 11$. Since no plunger stroke is adjusted by the stroke adjusting mechanism, however, the radius of revolution of the axis C4 is not varied, and the axis C4 revolves along a circular path F21. Before the first internal gear 31 is turned, the plunger 16 reaches the top dead center when the axis C4 is positioned at a point T1 of intersection between the path F2 and a straight line B that extends through the center C6 and the axis C5, and the plunger 16 reaches the bottom dead center when the axis C4 is positioned at another point B1 of intersection between the path F2 and the straight line B. After the first internal gear 31 is turned, the plunger 16 reaches the top dead center when the axis C4 is positioned at a point T11 of intersection between the path F21 and a straight line B1 that extends through the center C61 and the axis C5, and the plunger 16 reaches the bottom dead center when the axis C4 is positioned at another point B11 of intersection between the path F2 and the straight line B1.

Figure 13:
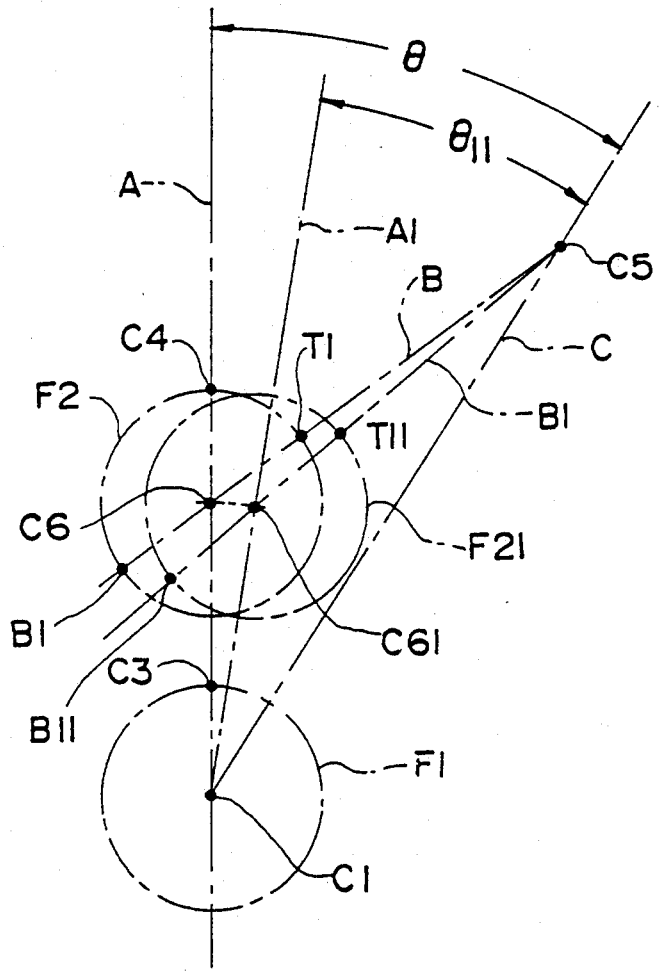
FIG. 13 is a schematic diagram showing how the positions of axes vary when the angular movement of a first internal gear of a W-mechanism of the compressor shown in FIG. 12 is controlled.

As can be seen from FIG. 13, the distances between the axis C5 and the points T1, T11 are different from each other, and hence the corresponding compression ratios RC differ from each other. More specifically, the compression ratio at the time the axis C4 is positioned at the point T1 corresponding to the top dead center before the first internal gear 31 is turned is smaller than the compression ratio at the time the axis C4 is positioned at the point T11 corresponding to the top dead center after the first internal gear 31 is turned. Consequently, the compression ratio can be adjusted as desired by rotating the worm pinion 36 to turn the first internal gear 31 of the W-mechanism.

When the compression ratio is adjusted in relation to stroke adjustment effected by the stroke adjusting mechanism, the compression ratio may be made constant for all plunger strokes as described below with reference to FIG. 14.

The axis C5 about which the cylinder 18 is rockable is selected such that the moving angle $\delta$ is of a minimum value of zero, when the plunger stroke is maximized by the stroke adjusting mechanism, and the moving angle $\delta$ is of a maximum value of $\delta 2$ when the plunger stroke is minimized by the stroke adjusting mechanism.

Figure 14:
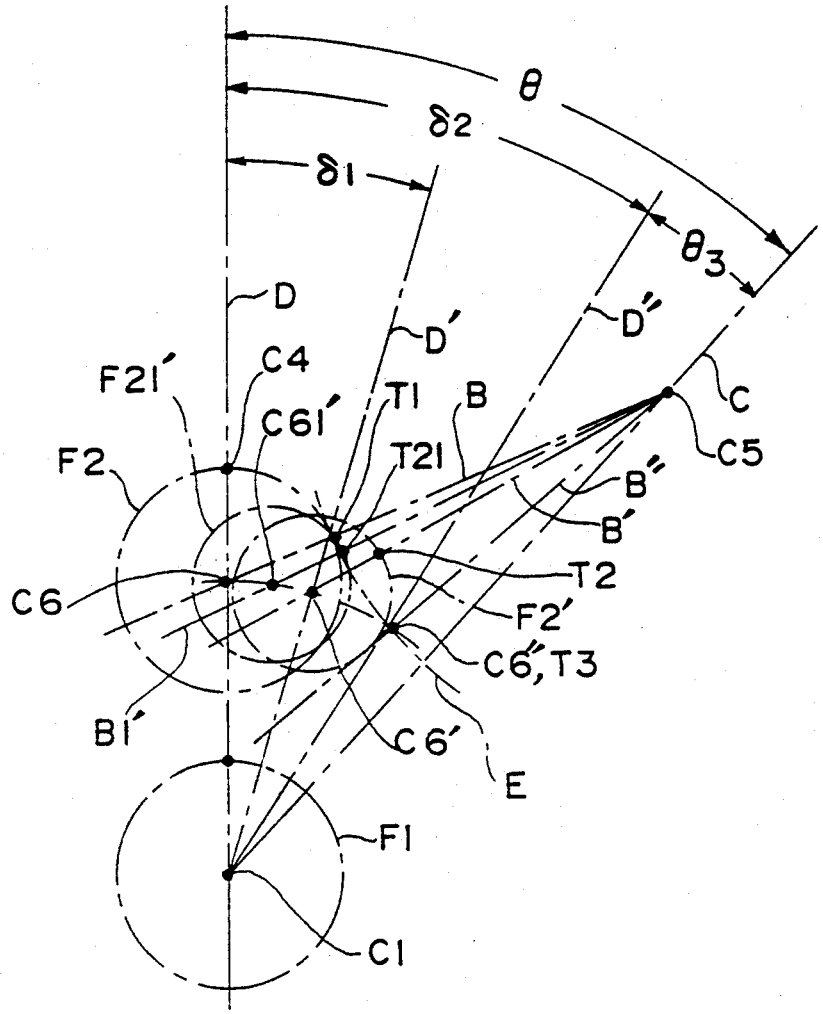
FIG. 14 is a schematic diagram showing how the positions of axes vary when the stroke of plungers of the compressor shown in FIG. 12 is adjusted in relation to the control of the angular movement of the first internal gear of the W-mechanism of the compressor.

As shown in FIG. 14, the cylinder deviation angle $\theta 2$ is selected to be larger than the maximum moving angle $\delta 2$, and a plane D'' passing through the axis C4 and the axis C1 when the plunger stroke is minimum is angularly spaced an angle $\theta 3$ from the plane C.

When the plunger stroke is maximum, the axis C4 revolves along the path F2, and the plunger 16 is positioned at the top dead center at the time the axis C4 is positioned at the point T1 of intersection between the circular path F2 and the line B extending through the axis C5 and the center C6 of the circular path F2. If the plunger stroke is adjusted by the stroke adjusting mechanism while the first internal gear 31 is being fixed, then, as described above with reference to FIG. 9, when the eccentric collar 13 is turned 90°, the axis around which the axis C4 revolves moves to a position C6', and the radius of revolution of the axis C4 is reduced, so that the circular path along which the axis C4 revolves is indicated by F2'. The plunger 16 is positioned at the top dead center when the axis C4 is positioned at a point T2 of intersection between the circular path F2' and a straight line B' extending through the axis C5 and the center C6' of the circular path F2'. When the eccentric collar 13 is further turned 90°, the axis around which the axis C4 revolves moves to a position C6'', and the radius of revolution becomes zero, so that the path along which the axis C4 revolves is superposed on the axis C6''.

In this embodiment, the position of the axis C5 is selected such that the distance from the position T1 of the axis C4 corresponding to the top dead center of the plunger 16 when the plunger stroke is maximum to the axis C5 is equal to the distance from a position T3 (which is the same as the axis C6'') of the axis C4 corresponding to the top dead center of the plunger 16 when the plunger stroke is minimum to the axis C5. Therefore, the clearance in the cylinder when the plunger 16 is at the top dead center with the maximum plunger stroke is equal to the clearance in the cylinder when the plunger 16 is at the top dead center with the minimum plunger stroke, resulting in the same compression ratio regardless of whether the plunger stroke is maximum or minimum.

When the plunger stroke is adjusted by the stroke adjusting mechanism with the first internal gear 31 fixed and the eccentric collar 13 is turned 90°, the distance from the position T2 of the axis C4 corresponding to the top dead center of the plunger 16 to the axis C5 is smaller than the corresponding distances with the maximum and minimum plunger strokes. Thus, at the same time as the stroke adjustment, the first internal gear 31 is turned to move the center C6' around which the axis C4 revolves to a position C61'. The axis C4 at the time the plunger 16 is at the top dead center is now moved to a position T21. The distance from the position T21 to the axis C5 is equal to the corresponding distances with the maximum and minimum plunger strokes.

Figure 15:
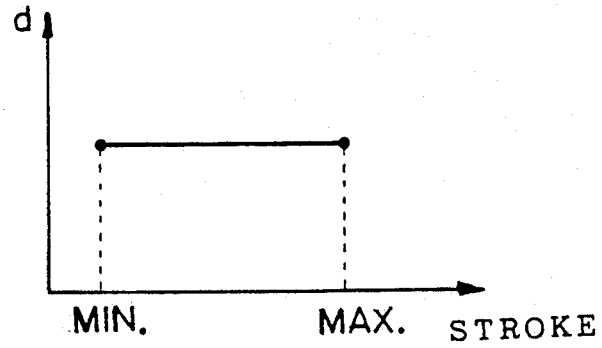
FIG. 15 is a graph showing the compression ratio of the compressor as it varies with the plunger stroke when the stroke of the plungers is adjusted in relation to the control of the angular movement of the first internal gear of the W-mechanism of the compressor.
Figure 16:
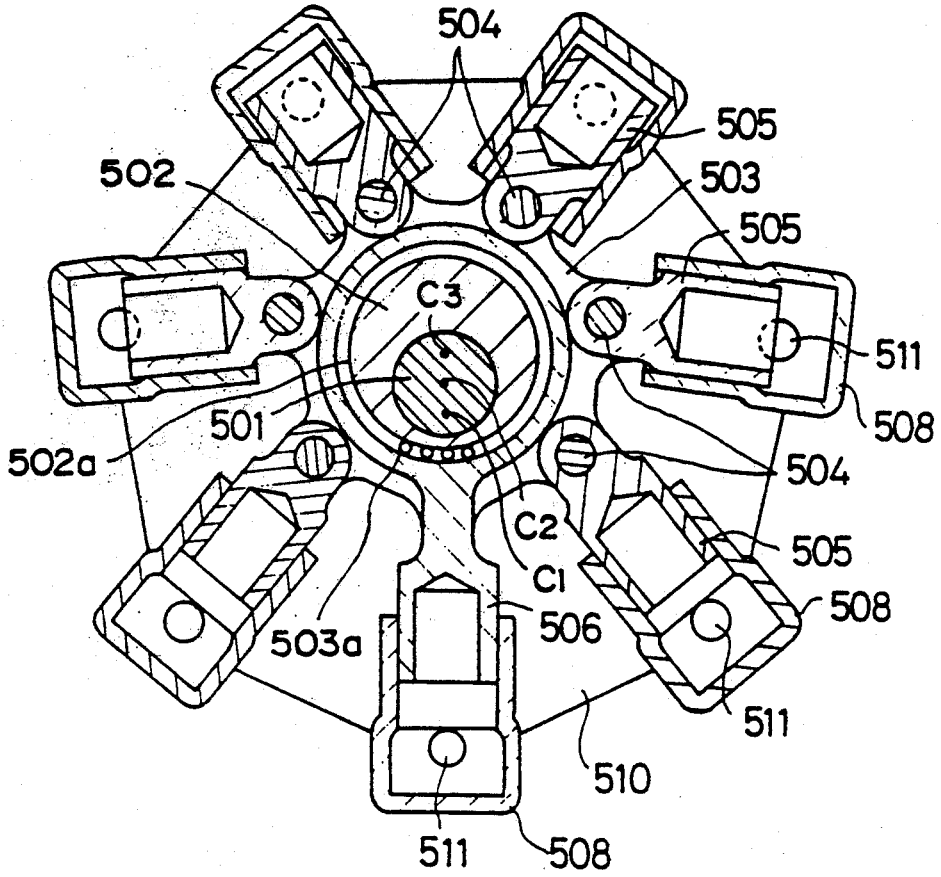
Fig. 16 (PRIOR ART)
FIG. 16 is a cross-sectional view of a conventional variable-stroke radial-plunger-type apparatus.
Figure 19:
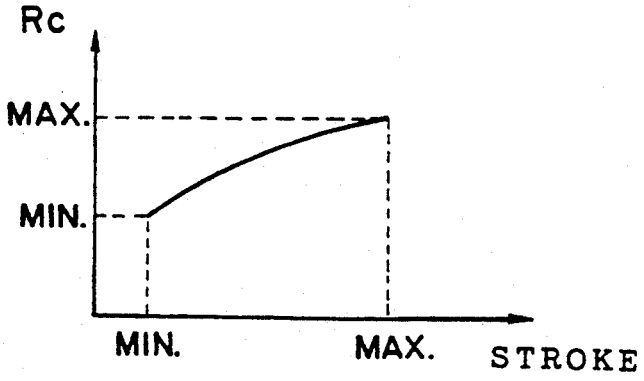
Fig. 19 (PRIOR ART)
FIG. 19 is a graph showing the compression ratio of the compressor as it varies with the plunger stroke in the conventional variable-stroke radial-plunger-type apparatus shown in FIG. 16.

Even when the plunger stroke is of a medium value, the clearance in the cylinder at the time the plunger 16 is at the top dead center is equal to those when the plunger stroke is maximum and minimum. Accordingly, as shown in FIG. 15, the clearance in the cylinder is made constant over the full range of plunger strokes. The compression ratio can therefore be rendered high for all plunger strokes, enabling the compressor to operate highly efficiently.

The angular movement of the first internal gear 31 is controlled such that the axis C4 when the plunger 16 is positioned at the top dead center for each plunger stroke is always equidistant from the axis C5, i.e., positioned on an arc E extending about the axis C5.

The rotational angle $\lambda$ of the first internal gear 31 has a constant relationship to the angular displacement $\gamma$ of the eccentric collar 13 caused by the stroke adjusting mechanism, and can be expressed as $\lambda = f(\gamma)$.

When the eccentric collar 13 is turned by the stroke adjusting mechanism to adjust the plunger stroke, the rotation of the worm pinion 36 may be controlled to turn the first internal gear 31 in a manner to satisfy the function $\lambda = f(\gamma)$ for thereby equalizing the clearances in the cylinder in the full plunger stroke range.

The present invention has been described with respect tot he variable-stroke radial-plunger-type compressors in which the plunger stroke can be adjusted by the stroke adjusting mechanism. However, the principle of the present invention are equally applicable to fixed-displacement radial-plunger-type compressors with a fixed plunger stroke. Such fixed-displacement radial-plunger-type compressors have no stroke adjusting mechanism and are capable of independently adjusting the compression ratio to a desired value.

Although certain preferred embodiments of the present invention have been shown and described in detail, it should be understood that various changes and modifications may be made therein without departing from the scope of the appended claims.

What is claimed is:

1. A radial-plunger-type apparatus comprising:

a casing assembly;

a main shaft relatively rotatably disposed in said casing assembly for rotation about a first axis and having a crankpin radially displaced off said first axis;

an eccentric collar angularly movably mounted on said crankpin and having an outer circumferential surface eccentric with respect to said crankpin;

a coupling ring angularly movably mounted on said outer circumferential surface of said eccentric collar;

a plunger extending radially outwardly and having a radially inner end pivotally supported on said coupling ring;

a cylinder having a cylinder bore, said plunger being slidably fitted in said cylinder bore through a radially inner end thereof, said cylinder being rockably attached to said casing assembly;

a stroke adjusting mechanism for adjusting the angular movement of said eccentric collar on said crankpin; and a W-mechanism for causing said coupling ring to revolve around said main shaft and preventing said coupling ring from rotating about its own axis when said main shaft is rotated with respect to said casing assembly.

2. A radial-plunger-type apparatus according to claim 1, wherein said W-mechanism has a first internal gear coupled to said casing assembly concentrically with said main shaft, an external gear rotatably mounted on said main shaft for rotation about said crankpin and held in mesh with said first internal gear, and a second internal gear disposed concentrically with said coupling ring for rotation in unison therewith and held in mesh with said external gear, said first and second internal gears having the same number of gear teeth, said external gear having a number of gear teeth which is smaller than the number of gear teeth of said first and second internal gears.

3. A radial-plunger-type apparatas according to claim 2, wherein said cylinder is rockable about a second axis with respect to said casing assembly, said plunger is angularly movable about a third axis with respect to said coupling ring, and said third axis is revolvable around a fourth axis in response to rotation of said main shaft, and wherein when the angular movement of said eccentric collar is adjusted by said stroke adjusting mechanism to maximize a reciprocating stroke of said plunger in said cylinder bore, said second axis is angularly spaced by a predetermined angle in a circumferential direction of the casing around said first axis from a reference plane which extends through said first axis and said fourth axis.

4. A radial-plunger-type apparatus according to claim 3, wherein said W-mechanism is arranged such that when the angular movement of said eccentric collar is adjusted by said stroke adjusting mechanism to reduce the reciprocating stroke of said plunger in said cylinder bore from the maximum reciprocating stroke, a first plane which extends through said fourth axis and said first axis is moved away from said reference plane toward a second plane which extends through said second axis and said first axis.

5. A radial-plunger-type apparatus according to claim 4, wherein said cylinder and said plunger slidably fitted in said cylinder bore have a variable compression ratio, said compression ratio being variable when the reciprocating stroke of said plunger is adjusted by said stroke adjusting mechanism and said first plane is moved by said W-mechanism upon adjustment of said reciprocating stroke, in such a range that the compression ratio increases as the reciprocating stroke of said plunger decreases.

6. A radial-plunger-type apparatus according to claim 1, wherein said W-mechanism has a first external gear coupled to said casing assembly concentrically with said main shaft, an internal gear rotatably mounted on said main shaft for rotation about said crankpin and held in mesh with said first external gear, and a second external gear disposed concentrically with said coupling ring for rotation in unison therewith and held in mesh with said internal gear, said first and second external gears having the same number of gear teeth, said internal gear having a number of gear teeth which is smaller than the number of gear teeth of said first and second external gears.

7. A radial-plunger-type apparatus according to claim 6, wherein said cylinder is rockable about a second axis with respect to said casing assembly, said plunger is angularly movable about a third axis with respect to said coupling ring, and said third axis is revolvable around a fourth axis in response to rotation of said main shaft, and wherein when the angular movement of said eccentric collar is adjusted by said stroke adjusting mechanism to maximize a reciprocating stroke of said plunger in said cylinder bore, said second axis is angularly spaced by a predetermined angle in a circumferential direction of the casing around said first axis from a reference plane which extends through said first axis and said fourth axis.

8. A radial-plunger-type apparatus according to claim 1, wherein said W-mechanism has a first sprocket coupled to said casing assembly concentrically with said main shaft, a second sprocket rotatably mounted on said main shaft for rotation about said crankpin and having a number of gear teeth different from the number of gear teeth of said first sprocket, a first chain trained around said first and second sprockets, a third sprocket disposed concentrically with said second sprocket for rotation in unison therewith and having the same number of gear teeth as the number of gear teeth of said second sprocket, a fourth sprocket disposed concentrically with said coupling ring for rotation in unison therewith and having the same number of gear teeth as the number of gear teeth of said first sprocket, and a second chain trained around said third and fourth sprockets.

9. A radial-plunger-type apparatus according to claim 8, wherein said cylinder is rockable about a second axis with respect to said casing assembly, said plunger is angularly movable about a third axis with respect to said coupling ring, and said third axis is revolvable around a fourth axis in response to rotation of said main shaft, and wherein when the angular movement of said eccentric collar is adjusted by said stroke adjusting mechanism to maximize a reciprocating stroke of said plunger in said cylinder bore, said second axis is angularly spaced by a predetermined angle in a circumferential direction of the casing around said first axis from a reference plane which extends through said first axis and said fourth axis.

10. A radial-plunger-type apparatus according to claim 1, further including a compression ratio adjusting mechanism for adjusting a clearance in said cylinder when the plunger is at a top dead center therein.

11. A radial-plunger-type apparatus according to claim 10, wherein said W-mechanism has a first internal gear relatively rotatably disposed in said casing assembly concentrically with said main shaft, an external gear rotatably mounted on said main shaft for rotation about said crankpin and held in mesh with said first internal gear, and a second internal gear disposed concentrically with said coupling ring for rotation in unison therewith and held in mesh with said external gear, said first and second internal gears having the same number of gear teeth, said external gear having a number of gear teeth which is smaller than the number of gear teeth of said first and second internal gears; and said compression ratio adjusting mechanism having means for angularly moving said first internal gear with respect to said casing to adjust said clearance.

12. A radial-plunger-type apparatus according to claim 11, wherein said cylinder is rockable about a second axis with respect to said casing assembly, said plunger is angularly movable about a third axis with respect to said coupling ring, and said third axis is revolvable around a fourth axis in response to rotation of said main shaft, and wherein when the angular movement of said eccentric collar is adjusted by said stroke adjusting mechanism to maximize a reciprocating stroke of said plunger in said cylinder bore, said second axis is angularly spaced by a predetermined angle in a circumferential direction of the casing around said first axis from a reference plane which extends through said first axis and said fourth axis.

13. A radial-plunger-type apparatus according to claim 11 or 12, wherein said eccentric collar is angularly movably mounted on said crankpin, further including a stroke adjusting mechanism for adjusting the angular movement of said eccentric collar on said crankpin to adjust a stroke of said plunger, whereby the radial-plunger-type apparatus is of the variable displacement type, and an angular movement control mechanism for controlling said compression ratio adjusting mechanism to angularly move said first internal gear in relation to the adjustment of the angular movement of said eccentric collar by said stroke adjusting mechanism.

14. A radial-plunger-type apparatus according to claim 13, wherein said angular movement control mechanism comprises means for controlling said compression ratio adjusting mechanism to control the angular movement of said first internal gear for canceling out a change in said clearance which is caused at the time the stroke of said plunger is adjusted by said stroke adjusting mechanism when said plunger is at the top dead center, so that said clearance or a compression ratio is kept constant at all times regardless of the adjustment of the stroke of said plunger by said stroke adjusting mechanism.

15. A radial-plunger-type apparatus according to claim 10, wherein said W-mechanism has a first external gear relatively rotatably disposed in said casing assembly concentrically with said main shaft, an internal gear rotatably mounted on said main shaft for rotation about said crankpin and held in mesh with said first external gear, and a second external gear disposed concentrically with said coupling ring for rotation in unison therewith and held in mesh with said internal gear, said first and second external gears having the same number of gear teeth, said internal gear having a number of gear teeth which is smaller than the number of gear teeth of said first and second external gears; and said compression ratio adjusting mechanism having means for angularly moving said first external gear with respect to said casing to adjust said clearance.

16. A radial-plunger-type apparatus according to claim 15, wherein said cylinder is rockable about a second axis with respect to said casing assembly, said plunger is angularly movable about a third axis with respect to said coupling ring, and said third axis is revolvable around a fourth axis in response to rotation of said main shaft, and wherein when the angular movement of said eccentric collar is adjusted by said stroke adjusting mechanism to maximize a reciprocating stroke of said plunger in said cylinder bore, said second axis is angularly spaced by a predetermined angle in a circumferential direction of the casing around said first axis from a reference plane which extends through said first axis and said fourth axis.

17. A radial-plunger-type apparatus according to claim 10, wherein said W-mechanism has a first sprocket coupled to said casing assembly concentrically with said main shaft, a second sprocket rotatably mounted on said main shaft for rotation about said crankpin and having a number of gear teeth different from the number of gear teeth of said first sprocket, a first chain trained round said first and second sprockets, a third sprocket disposed concentrically with said second sprocket for rotation in unison therewith and having the same number of gear teeth as the number of gear teeth of said second sprocket, a fourth sprocket disposed concentrically with said coupling ring for rotation in unison therewith and having the same number of gear teeth as the number of gear teeth of said first sprocket, and a second chain trained around said third and fourth sprockets; and said compression ratio adjusting mechanism having means for angularly moving said first sprocket with respect to said casing to adjust said clearance.

18. A radial-plunger-type apparatus according to claim 17, wherein said cylinder is rockable about a second axis with respect to said casing assembly, said plunger is angularly movable about a third axis with respect to said coupling ring, and said third axis is revolvable around a fourth axis in response to rotation of said main shaft, and wherein when the angular movement of said eccentric collar is adjusted by said stroke adjusting mechanism to maximize a reciprocating stroke of said plunger in said cylinder bore, said second axis is angularly spaced by a predetermined angle in a circumferential direction of the casing around said first axis from a reference plane which extends through said first axis and said fourth axis.

19. A radial-plunger-type apparatus comprising:

a casing assembly;

a main shaft relatively rotatably disposed in said casing assembly for rotation about a first axis and having a crankpin radially displaced off said first axis;

an eccentric collar angularly movably mounted on said crankpin and having an outer circumferential surface eccentric with respect to said crankpin;

a coupling ring angularly movably mounted on said outer circumferential surface of said eccentric collar;

a plunger extending radially outwardly and having a radially inner end pivotally supported on said coupling ring;

a cylinder having a cylinder bore, said plunger being slidably fitted in said cylinder bore through a radially inner end thereof, said cylinder being rockably attached to said casing assembly;

a stroke adjusting mechanism for adjusting the angular movement of said eccentric collar on said crankpin; and a W-mechanism for allowing said coupling ring to revolve around said main shaft without rotation about its own axis;

wherein said W-mechanism has a first internal gear coupled to said casing assembly concentrically with said main shaft, an external gear rotatably mounted on said main shaft for rotation about said crankpin and held in mesh with said first internal gear, and a second internal gear disposed concentrically with said coupling ring for rotation in unison therewith and held in mesh with said external gear, said first and second internal gears having the same number of gear teeth, said external gear having a number of gear teeth which is smaller than the number of gear teeth of said first and second internal gears.

20. A radial-plunger-type apparatus according to claim 19, wherein said cylinder is rockable about a second axis with respect to said casing assembly, said plunger is angularly movable about a third axis with respect to said coupling ring, and said third axis is revolvable around a fourth axis in response to rotation of said main shaft, and wherein when the angular movement of said eccentric collar is adjusted by said stroke adjusting mechanism to maximize a reciprocating stroke of said plunger in said cylinder bore, said second axis is angularly spaced by a predetermined angle in a circumferential direction of the casing around said first axis from a reference plane which extends through said first axis and said fourth axis.

21. A radial-plunger-type apparatus according to claim 20, wherein said W-mechanism is arranged such that when the angular movement of said eccentric collar is adjusted by said stroke adjusting mechanism to reduce the reciprocating stroke of said plunger in said cylinder bore from the maximum reciprocating stroke, a first plane which extends through said fourth axis and said first axis is moved away from said reference plane toward a second plane which extends through said second axis and said first axis.

22. A radial-plunger-type apparatus according to claim 21, wherein said cylinder and said plunger slidably fitted in said cylinder bore have a variable compression ratio, said compression ratio being variable when the reciprocating stroke of said plunger is adjusted by said stroke adjusting mechanism and said first plane is moved by said W-mechanism upon adjustment of said reciprocating stroke, in such a range that the compression ratio increases as the reciprocating stroke of said plunger decreases.

23. A radial-plunger-type apparatus comprising:

a casing assembly;

a main shaft relatively rotatably disposed in said casing assembly for rotation about a first axis and having a crankpin radially displaced off said first axis;

an eccentric collar angularly movably mounted on said crankpin and having an outer circumferential surface eccentric with respect to said crankpin;

a coupling ring angularly movably mounted on said outer circumferential surface of said eccentric collar;

a plunger extending radially outwardly and having a radially inner end pivotally supported on said coupling ring;

a cylinder having a cylinder bore, said plunger being slidably fitted in said cylinder bore through a radially inner end thereof, said cylinder being rockably attached to said casing assembly;

a stroke adjusting mechanism for adjusting the angular movement of said eccentric collar on said crankpin; and a W-mechanism for allowing said coupling ring to revolve around said main shaft without rotation about its own axis;

wherein said cylinder is rockable about a second axis with respect to said casing assembly, said plunger is angularly movable about a third axis with respect to said coupling ring, and said third axis is revolvable around a fourth axis in response to rotation of said main shaft, and wherein when the angular movement of said eccentric collar is adjusted by said stroke adjusting mechanism to maximize a reciprocating stroke of said plunger in said cylinder bore, said second axis is angularly spaced by a predetermined angle in a circumferential direction of the casing around said first axis from a reference plane which extends through said first axis and said fourth axis.

24. A radial-plunger-type apparatus according to claim 23, wherein said W-mechanism is arranged such that when the angular movement of said eccentric collar is adjusted by said stroke adjusting mechanism to reduce there ciprocating stroke of said plunger in said cylinder bore from the maximum reciprocating stroke, a first plane which extends through said fourth axis and said first axis is moved away from said reference plane toward a second plane which extends through said second axis and said first axis.

25. A radial-plunger-type apparatus according to claim 24, wherein said cylinder and said plunger slidably fitted in said cylinder bore have a variable compression ratio, said compression ratio being variable when the reciprocating stroke of said plunger is adjusted by said stroke adjusting mechanism and said first plane is moved by said W-mechanism upon adjustment of said reciprocating stroke, in such a range that the compression ratio increases as the reciprocating stroke of said plunger decreases.

* * * * *

UNITED STATES PATENT AND TRADEMARK OFFICE

CERTIFICATE OF CORRECTION

PATENT NO. : 5,280,745

DATED : January 25, 1994

INVENTOR(S) : Maruno, F.

It is certified that error appears in the above-indentified patent and that said Letters Patent is hereby corrected as shown below:

Column 26, line 7, delete "there ciprocating" and substitute -- the reciprocating --.

Signed and Sealed this

Twenty-third Day of August, 1994

Bruce Lehman

*Attest:*

BRUCE LEHMAN

*Attesting Officer*

*Commissioner of Patents and Trademarks*